US009296232B2

(12) United States Patent
Aizawa

(10) Patent No.: US 9,296,232 B2
(45) Date of Patent: Mar. 29, 2016

(54) THERMAL PRINTER

(71) Applicant: SEIKO INSTRUMENTS INC., Chiba-shi, Chiba (JP)

(72) Inventor: Kazuyuki Aizawa, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 0 days.

(21) Appl. No.: 14/308,084

(22) Filed: Jun. 18, 2014

(65) Prior Publication Data

US 2015/0002604 A1 Jan. 1, 2015

(30) Foreign Application Priority Data

Jun. 28, 2013 (JP) ..... 2013-136988

(51) Int. Cl.

| | |
|---|---|
| ***B41J 2/165*** | (2006.01) |
| ***B41J 29/02*** | (2006.01) |
| ***B41J 29/13*** | (2006.01) |
| ***B41J 29/38*** | (2006.01) |

(52) U.S. Cl.

CPC *B41J 29/02* (2013.01); *B41J 29/13* (2013.01); *B41J 29/38* (2013.01)

(58) Field of Classification Search

None

See application file for complete search history.

(56) References Cited

U.S. PATENT DOCUMENTS

| | | | | |
|---|---|---|---|---|
| 7,492,383 | B2 * | 2/2009 | Hirai | 347/220 |
| 2012/0218354 | A1 * | 8/2012 | Maekawa | 347/47 |

FOREIGN PATENT DOCUMENTS

| | | |
|---|---|---|
| JP | 2009029092 | 2/2009 |

* cited by examiner

*Primary Examiner* — Alejandro Valencia

(74) *Attorney, Agent, or Firm* — Adams & Wilks

(57) ABSTRACT

A thermal printer has a casing that houses recording paper, a printer cover connected to the casing in a manner turnable with respect to the casing around a first turning shaft for opening/closing the casing, a head unit provided on the casing and including a thermal head, and a platen unit including a platen roller and being provided on the printer cover and connected to the head unit in a manner releasable along with an opening/closing operation of the printer cover. The platen unit is mounted on the printer cover in a manner turnable around a second turning shaft that is parallel to the first turning shaft and slidable along a direction perpendicular to the second turning shaft. A biasing member is provided between the printer cover and the platen unit for biasing the platen unit toward the closing direction of the printer cover around the second turning shaft.

10 Claims, 17 Drawing Sheets

THERMAL PRINTER

BACKGROUND OF THE INVENTION

1. Field of the Invention

The present invention relates to a thermal printer.

2. Description of the Related Art

As a thermal printer, there is known a structure including a line thermal head (hereinafter, simply referred to as a thermal head) and a platen roller to be in contact with the thermal head that are assembled in a manner releasable (separation type). In such a separation type thermal printer, for example, a head unit including a thermal head is mounted on a side of a case that houses roll paper, and a platen unit including the platen roller is mounted on a side of a printer cover connected to the case in such a manner that the platen roller can be opened/closed. According to this structure, the thermal head and the platen roller can be assembled in a manner releasable along with open/close operation of the printer cover. Therefore, workability upon setting of recording paper, upon paper jam handling, upon maintenance, replacement, or the like of the thermal head, the platen roller, or the like can be improved comparing to a structure including a head unit and a platen unit that are integrally assembled in a case (integrated type).

The above-described separation type thermal printer generally includes a lock mechanism that detachably holds the platen roller when the printer cover is closed. Thus, the thermal printer is generally structured in such a manner that the platen roller is assembled with the thermal head while the whole platen roller is in uniform pressure contact with the thermal head.

However, practically, there is some component precision error, assembly error, or the like. Thus, when the printer cover is closed, failure such as insufficient lock of the platen roller, impossible lock itself, and non-uniform contact of the whole platen roller with the thermal head is occasionally caused even when lock is possible. Therefore, measures to cancel component precision error, assembly error, or the like are thought of.

As one example of conventional measures, there is known a structure including a pair of locking pins provided on a case side, and a pair of catches, which is provided on a printer cover side and to which the respective locking pins are locked so as to be interlocked with each other, wherein one of the catches has a contour enlarged portion having a size equivalent to a displacement amount of the printer cover due to looseness.

However, the above-described conventional technique still has a following issue. For open operation of a printer cover, operation of a releasing part (such as a release lever and a release button) that releases a lock mechanism is generally required, enabling to restrict users to perform common operation. On the other hand, for close operation, users can perform pressing operation at any position of the printer cover, allowing different operation positions depending on users. For example, pressing operation may be performed on a part of the printer cover at a position corresponding to a central part in a longitudinal direction of a platen roller mounted on the printer cover, or may be performed on a part thereof at a position corresponding to an end part of the platen roller, for example. That is, operation positions are not limited to a single position.

When a user performs pressing operation on a portion of the printer cover at a position corresponding to one end of the platen roller (presses one side of the printer cover), the pressing force concentrates on one bearing member side mounted on the platen shaft. That is, pressing force on the printer cover varies due to influence of operation positions of the printer cover, and thus the platen unit occasionally moves to obliquely incline. As a result, failure of so-called one-side lock where only the one bearing member side is locked and the other bearing member side is not locked or sufficiently locked is occasionally caused. When one-side lock is caused, the platen roller does not come into contact with the thermal head with uniform and appropriate contact pressure, causing defective printing and degradation of printing quality, and also causing occasional paper jam or the like.

SUMMARY OF THE INVENTION

In view of the foregoing drawbacks in the related art, a thermal printer that does not cause one-side lock and is capable of securely assembling a thermal head and a platen roller in an appropriate setting state has been desired.

A printer according to one aspect of the present invention is a thermal printer comprises: a casing that houses recording paper; a printer cover connected to the casing in a manner turnable with respect to the casing around a first turning shaft and opening/closing the casing; a head unit provided on the casing and including a thermal head; and a platen unit provided on the printer cover, that is assembled to the head unit in a manner releasable along with open/close operation of the printer cover, and that includes a platen roller for feeding the recording paper, wherein the platen unit is mounted on the printer cover in a manner turnable around a second turning shaft that is parallel to the first turning shaft and slidable along a direction perpendicular to the second turning shaft, and the thermal printer further includes a biasing member that biases the platen unit in a direction away from the printer cover out of turn directions of the platen unit around the second turning shaft is provided between the printer cover and the platen unit.

According to this structure, the platen unit is not fixed integrally to the printer cover, but is mounted on the printer cover slidably along the printer cover and swingably around the second turning shaft that is parallel to the first turning shaft. Thus, the whole platen unit appropriately slides and swings with respect to the printer cover while the printer cover is being closed, whereby component precision error, assembly error, or the like of the respective components can be canceled, if any. Therefore, the platen unit can be securely locked to the head unit.

In particular, the biasing member biases the platen unit in the direction away from the printer cover (a close direction of the printer cover), suppressing looseness of the platen roller (platen unit) with respect to the printer cover. Thus, during close operation of the printer cover, variation of relative positions of the platen unit on the printer cover side with respect to the head unit on the casing side can be suppressed, and variation of pressing force on the printer cover due to influence of operation positions of the printer cover can be suppressed. As a result, the platen unit can be securely locked to the head unit even by pressing one side of the printer cover. Therefore, conventionally caused one-side lock is not caused and secure assembly between the thermal head and the platen roller in an appropriate setting state is possible. Therefore, occurrence of paper jam and the like can be suppressed as well as high quality printing is possible.

In the printer according to the one aspect of the present invention, the printer cover may comprise: an outer cover exposed to the outside; and a reinforcing member that reinforces the outer cover from the inner surface side. According to this structure, the printer cover is structured with a plurality of components including the outer cover and the reinforcing member that reinforces the outer cover, enabling weight reduction and material cost reduction comparing to a printer cover structured with one component while securing rigidity of the whole printer cover 3. In addition, since rigidity of the printer cover is secured, deformation such as deflection and twisting of the outer cover during close operation of the printer cover can be suppressed. Thus, the whole platen unit can be uniformly pressed regardless of an operation position of the printer cover, securely suppressing the above-described one-side lock.

In the printer according to the one aspect of the present invention, the reinforcing member may comprise a first reinforcing member that is provided in an area of the outer cover where the outer cover overlaps the second turning shaft. According to this structure, the first reinforcing member is arranged at a position of the printer cover where the printer cover overlaps the second turning shaft, the position being closer to an operation position of the printer cover rather than the first turning shaft side, whereby securing rigidity around the operation position of the printer cover. Therefore, the above-described one-side lock can be securely suppressed.

In the printer according to the one aspect of the present invention, the reinforcing member may comprise a second reinforcing member that is provided in an area of the outer cover positioned between the first turning shaft and the second turning shaft. According to this structure, the second reinforcing member is arranged at a part of the outer cover positioned between the first turning shaft and the second turning shaft, whereby rigidity against moment around the first turning shaft can be secured during close operation of the printer cover. Thus, the above-described one-side lock can be securely suppressed.

As described above, the printer according to the one aspect of the present invention does not cause one-side lock and is capable of securely assembling the thermal head and the platen roller in an appropriate setting state.

DETAILED DESCRIPTION OF THE PREFERRED EMBODIMENTS

A description will hereinafter be given of an embodiment of the present invention with reference to the accompanying drawings.

Figure 1:
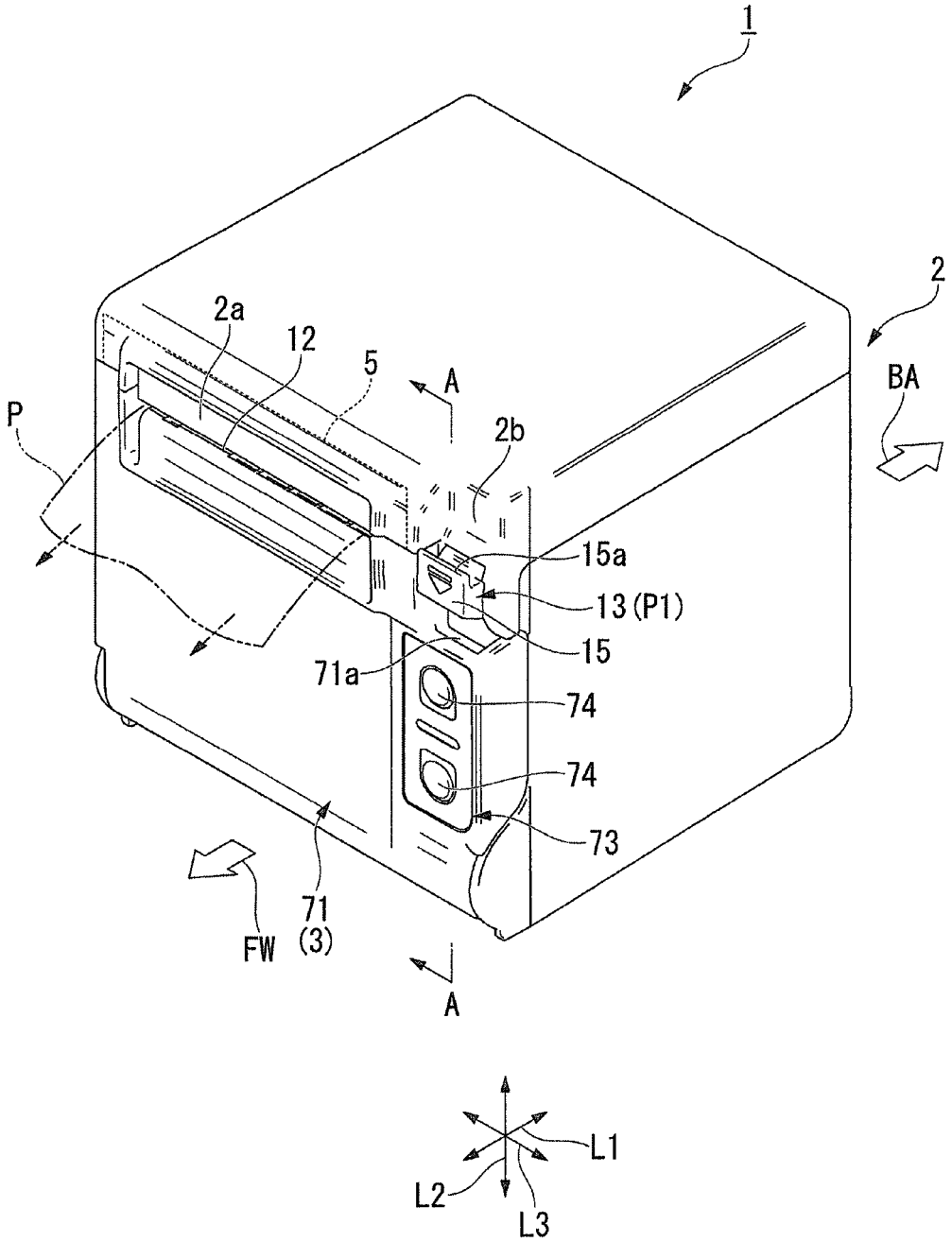
FIG. 1 is a perspective view illustrating a thermal printer in a closed position of a printer cover.
Figure 2:
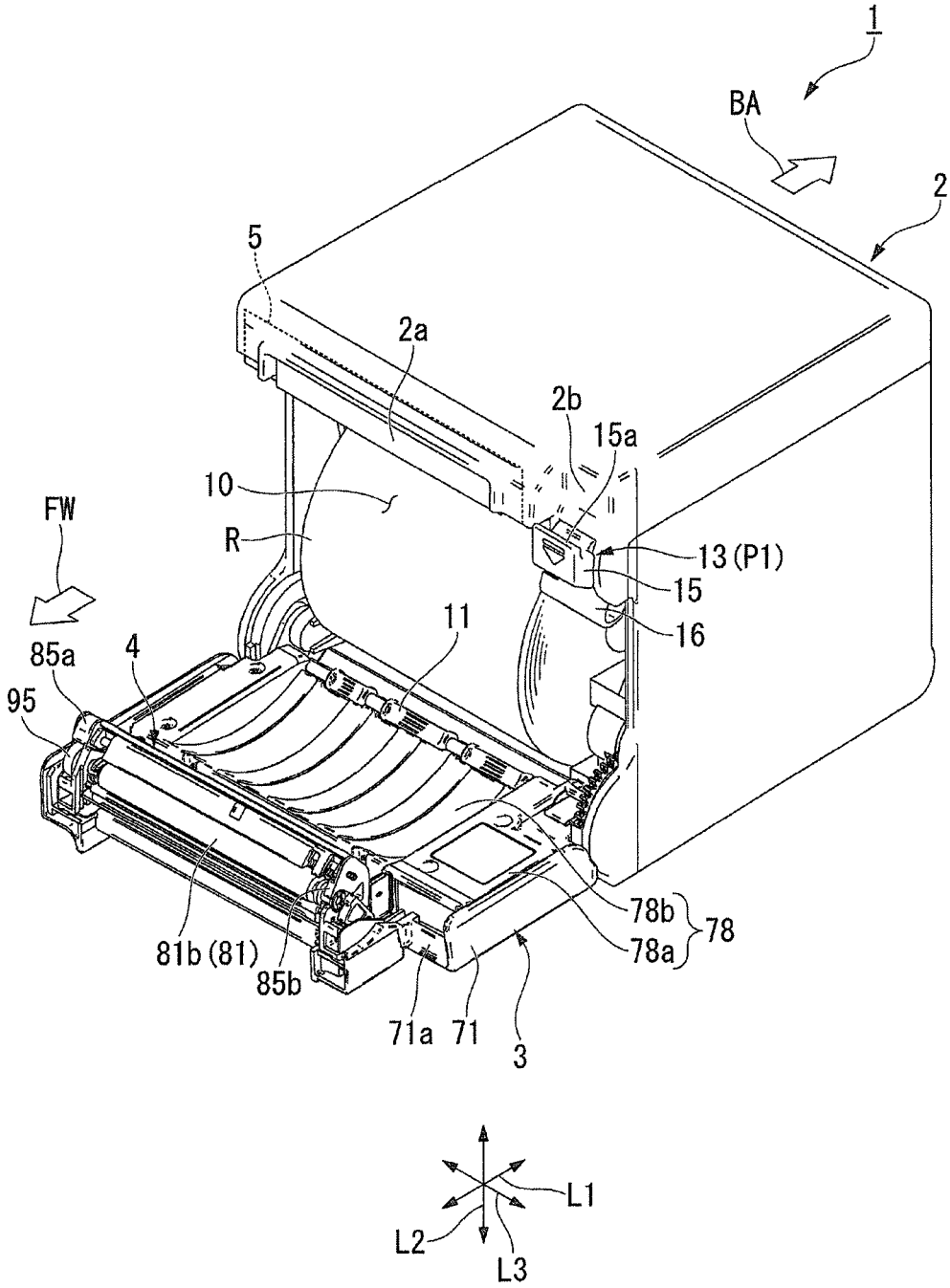
FIG. 2 is a perspective view illustrating the thermal printer in an open position of the printer cover.
Figure 3:
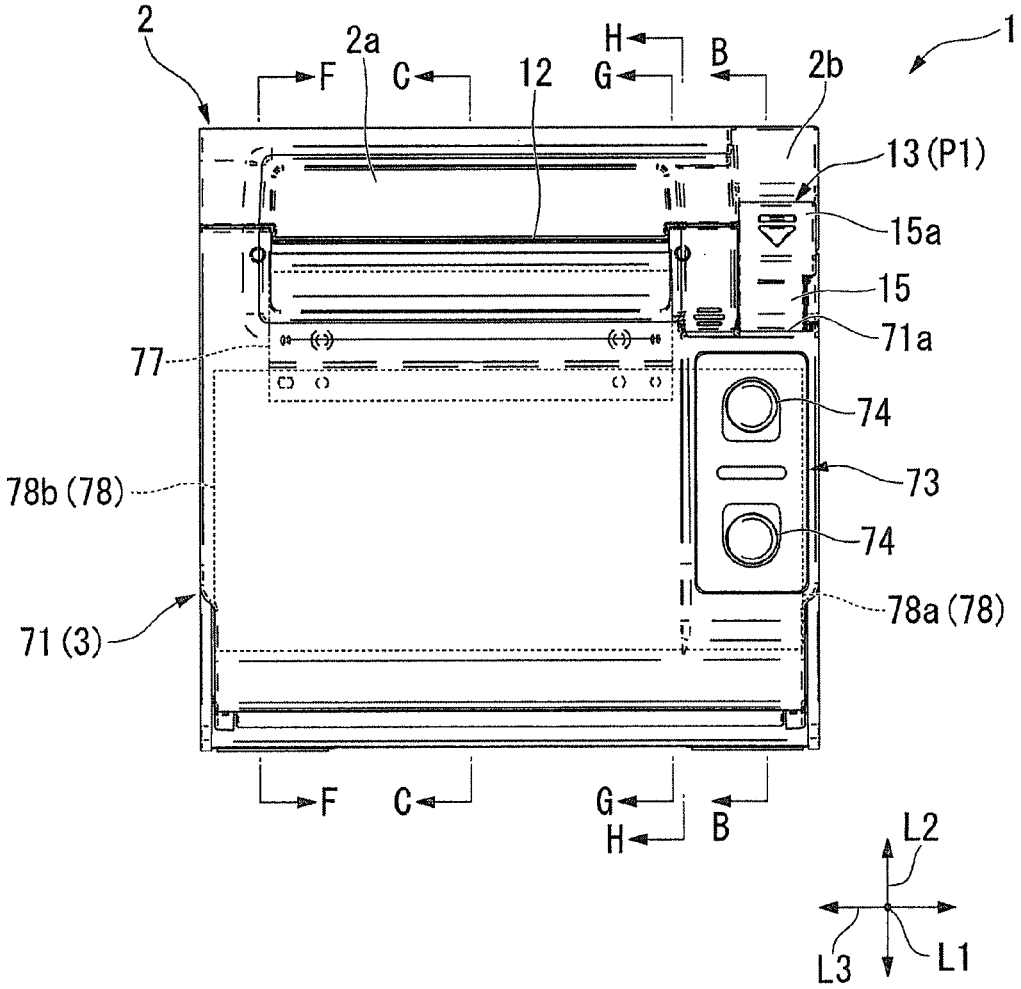
FIG. 3 is a front view of the thermal printer in the closed position of the printer cover.

FIG. 1 is a perspective view illustrating a thermal printer 1 with the printer cover 3 at a closed position. FIG. 2 is a perspective view illustrating the thermal printer 1 with the printer cover 3 at an open position, and FIG. 3 is a front view of the thermal printer 1 with the printer cover 3 at the closed position. As illustrated in FIGS. 1 to 3, the thermal printer 1 of this embodiment is a printer that prints on recording paper P (thermal paper) drawn from the roll paper R (refer to FIG. 2), allowing the recording paper P to be used as a ticket, a receipt, or the like. The thermal printer 1 includes a casing 2, the printer cover 3, a platen unit 4 (refer to FIG. 2) provided on the printer cover 3 side, and a head unit 5 (refer to FIG. 2) provided on the casing 2 side.

In this embodiment, when the printer cover 3 is at the closed position as illustrated in FIG. 1, the lower left side with respect to the sheet (the printer cover 3 side) is the front side (in a direction of an arrow FW), the upper right side (the casing 2 side) is the back side (in a direction of an arrow BA), the upper side is the upper side, and the lower side is the lower side of the thermal printer 1. Recording paper P is discharged forward FW. A direction that is perpendicular to a forward/backward direction L1 and a vertical direction L2 is indicated by a left/right direction L3. Thus, each direction may appear differently in the respective drawings.

As illustrated in FIG. 2, the casing 2 is formed of a resin material, a metal material, or appropriate combination thereof in a cube shape that can open forward FW. The casing 2 includes a frame body as a basic frame and an outer cover covering the frame body.

Inside the casing 2, a roll paper storage 10 storing the roll paper R is formed. The roll paper storage 10 is made open by opening the printer cover 3. The roll paper storage 10 is constituted by a part of the above-described frame body to have a box shape and that can open forward FW. The roll paper R is stored inside the roll paper storage 10 with the width direction aligned in the left/right direction L3.

In addition, in the lower part of the opening edge of the casing 2, a first turning shaft 11 extending along the left/right direction L3 is provided. To the first turning shaft 11, the printer cover 3 is connected in a manner turnable with respect to the casing 2. The printer cover 3 opens/closes the opening of the casing 2 by turning in an angle range of about 90° (dashed line T1 in FIG. 6) between a closed position (in the state of FIG. 1) where the printer cover 3 closes the opening of the casing 2 and an open position where the printer cover 3 opens the opening of the casing 2. When the printer cover 3 is at the open position, the roll paper storage 10 is made open, allowing the roll paper R to be put into the roll paper storage 10 (so-called drop-in mechanism), for example.

As illustrated in FIG. 1, the thermal printer 1 of the present embodiment is designed to make a little gap between the distal end part (upper end part in FIG. 1) of the printer cover 3 and the casing 2 when the printer cover 3 is at the closed position. The recording paper P is then drawn forward FW from the inside of the casing 2 utilizing the gap. Thus, the above-described gap functions as a discharge port 12 of the recording paper P. The casing 2 and the printer cover 3 at the closed position are locked by assembling the platen unit 4 and the head unit 5 (this will be described in detail later).

Among corners positioned on the upper front side of the casing 2 in the present embodiment, at a corner positioned on one side in the left/right direction L3, a release lever 13 for open operation of the printer cover 3 by releasing assembly between the platen unit 4 and the head unit 5 is provided.

Figure 4:
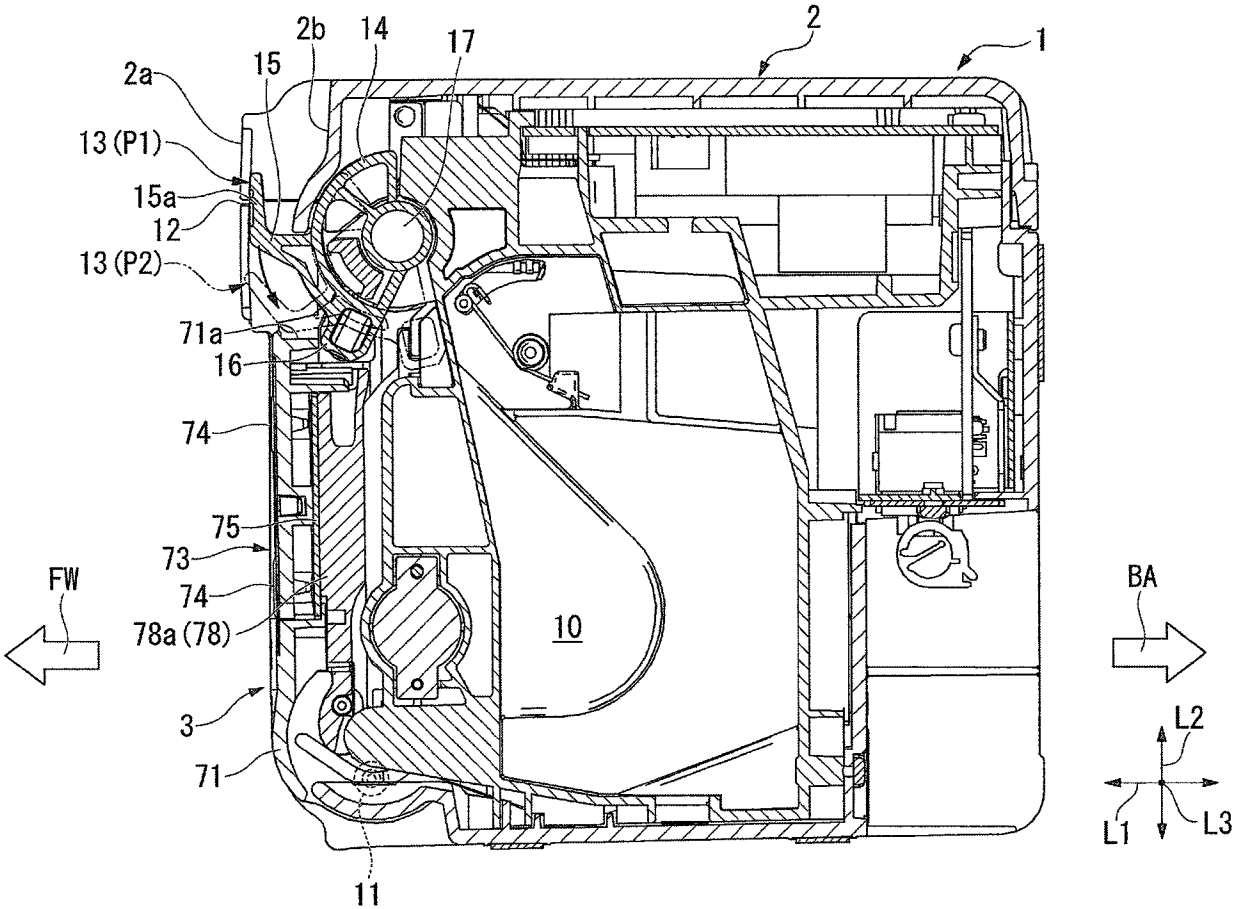
FIG. 4 is a sectional view taken along the line A-A of FIG. 1.

FIG. 4 is a sectional view taken along the line A-A of FIG. 1. As illustrated in FIGS. 3 and 4, turning operation of the release lever 13 is possible between a lock position P1 and a release position P2. When the release lever 13 is moved to the release position P2, lock between the casing 2 and the printer cover 3 is released. More specifically, the release lever 13 includes a lever body 14, an operation projection 15, and a connection body 16.

As illustrated in FIG. 4, the lever body 14 is semicircular in the side view seen in the left/right direction L3. The lever body 14 is placed inside a recessed surface 2*b* that is recessed backward of a front surface 2*a* of the casing 2, and connected in a manner turnable with respect to a connecting shaft 17 (refer to FIG. 4), which is provided in the frame body and extends in the left/right direction L3. Thus, the release lever 13 is turnable upward and downward around the connecting shaft 17. Note that, the lever body 14 is biased by a biasing member such as a spring, which is not illustrated, so that the release lever is biased toward the lock position P1.

The operation projection 15 is connected to a front part of the lever body 14, projects forward FW from the recessed surface 2*b*, and exposed to the outside of the casing 2. In addition, in a front end part of the operation projection 15, an operation projecting piece 15*a* projecting upward is formed. Thus, turning operation of the release lever 13 is possible from the lock position P1 to the release position P2 while hooking fingers on the operation projecting piece 15*a*, for example. The front end part of the operation projection 15 is flush with the front surface 2*a* of the casing 2 so as to be flat with the front surface 2*a*.

Figure 5:
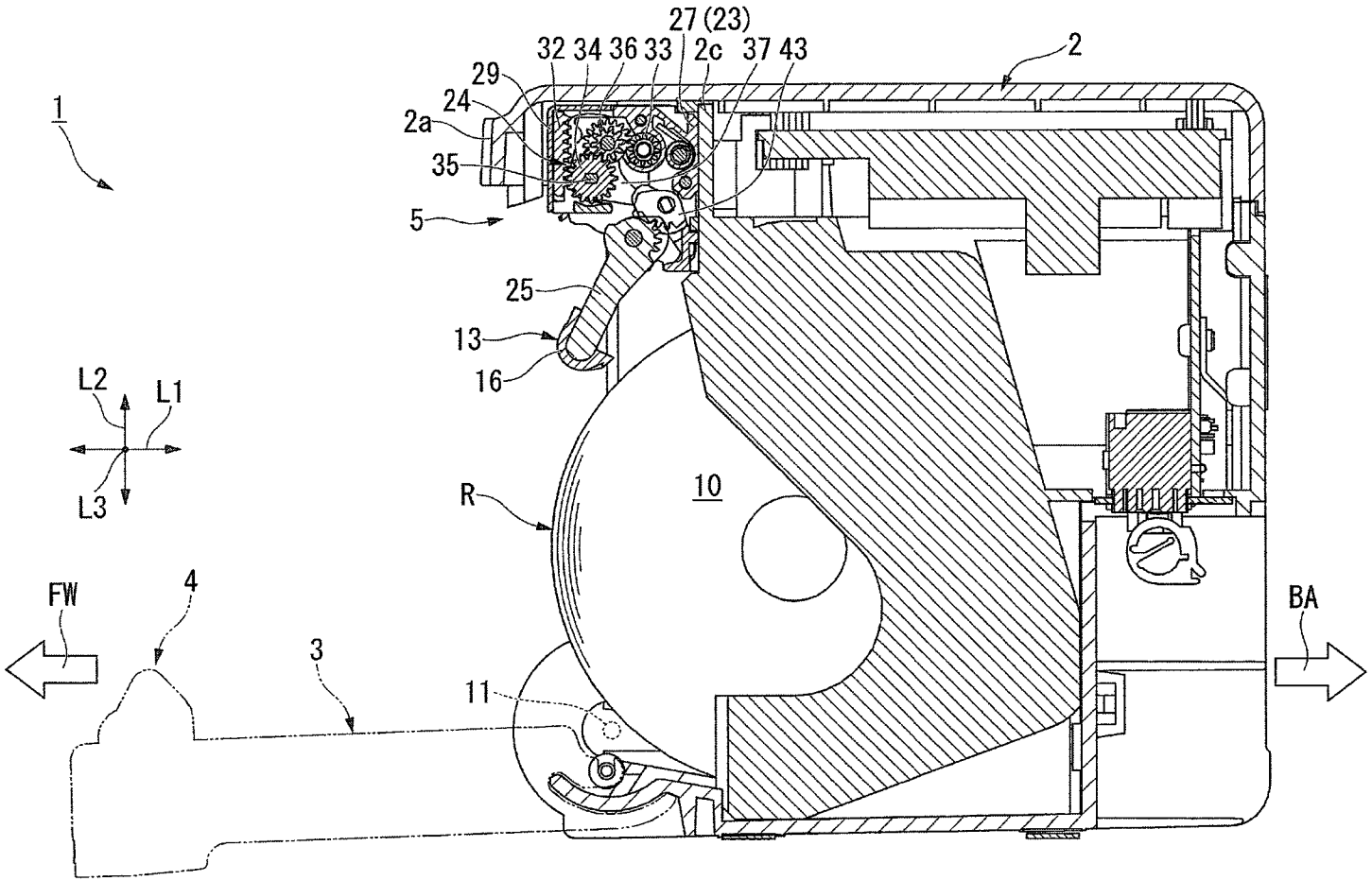
FIG. 5 is a sectional view taken along the line B-B of FIG. 3.

FIG. 5 is a sectional view taken along the line B-B in FIG. 3. As illustrated in FIGS. 4 and 5, the connection body 16 is formed to have a U-shape section projecting from the lower end of the lever body 14 inward of the left/right direction L3. A lever part 25 of the head unit 5 is fitted in the connection body 16. The lever part 25 will be described later.

Figure 6:
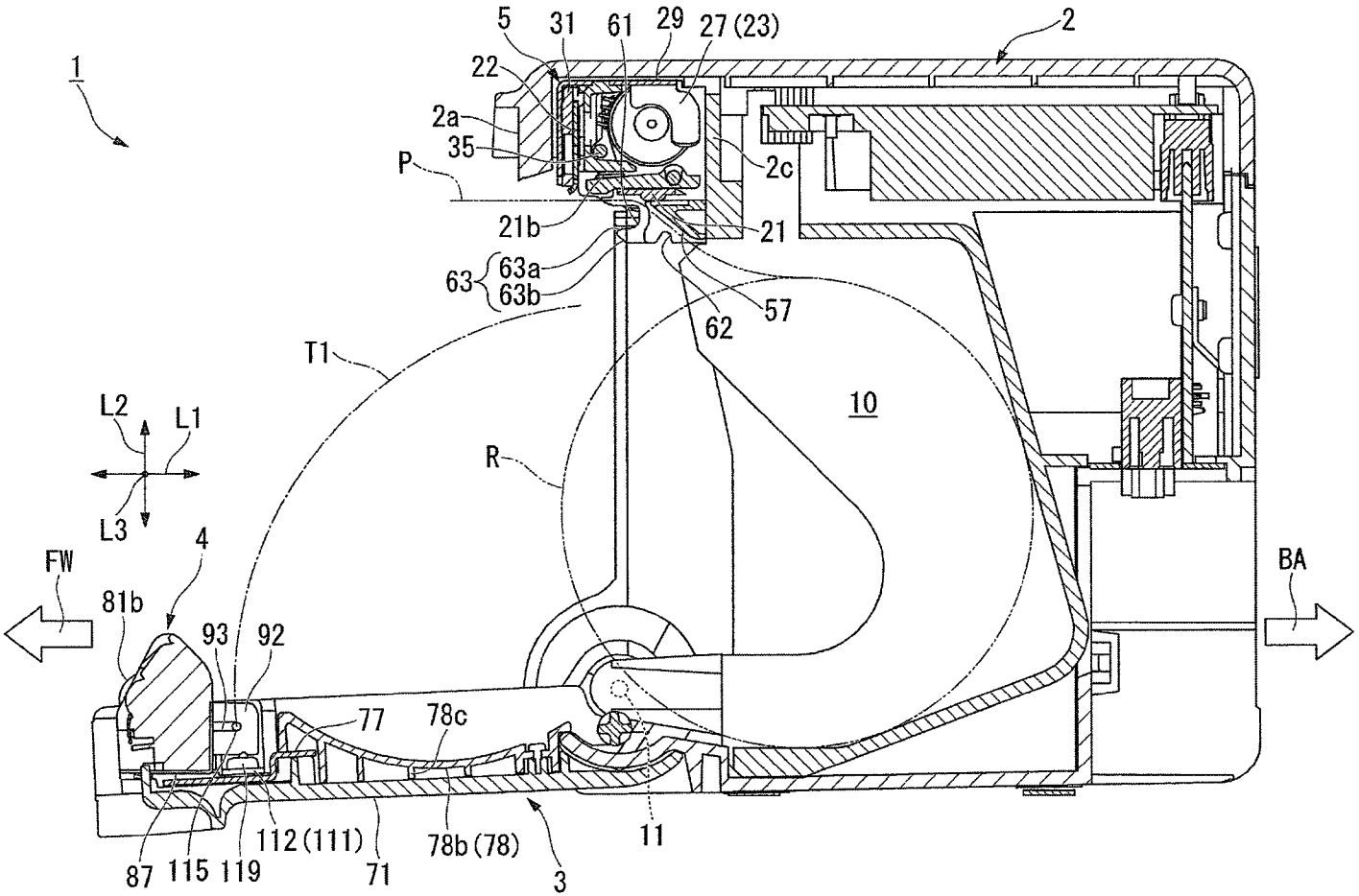
FIG. 6 is a sectional view taken along the line C-C of FIG. 3.

FIG. 6 is a sectional view taken along the line C-C of FIG. 3. As illustrated in FIG. 6, the above-described head unit 5 is a unit mainly includes a thermal head 21 and a movable blade 22, and is provided on the upper front side in the casing 2. In the example illustrated in FIG. 6, the head unit 5 is fixed on an internal plate 2*c* and held frontward FW of the roll paper storage 10, the internal plate 2*c* extending downward from the upper surface of the casing 2.

Figure 7:
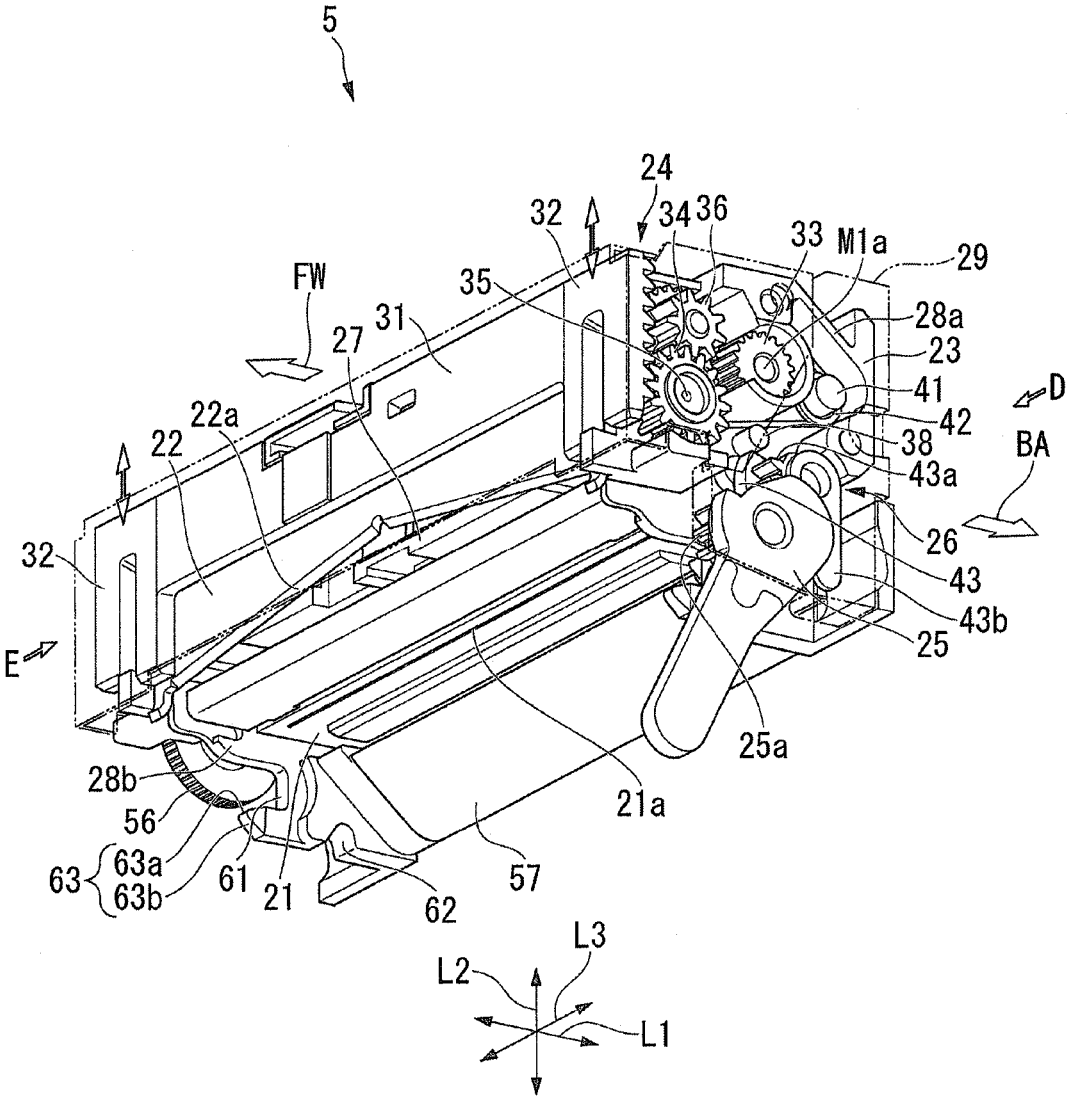
FIG. 7 is a perspective view of a head unit as seen from below thereof.

FIG. 7 is a perspective view of the head unit 5 as seen from below thereof. As illustrated in FIGS. 6 and 7, the head unit 5 includes a metal head frame 23 fixed on the internal plate 2*c*, the above-described thermal head 21 and movable blade 22, a movable blade driving system 24 that drives the movable blade 22, the lever part 25 supported by the head frame 23 in a manner turnable, and a release mechanism 26 (refer to FIG. 7) that releases transmission of driving force to the movable blade 22 along with turning operation of the lever part 25. Meanwhile, as illustrated in FIG. 7, the head frame 23 includes a base 27 extending along the left/right direction L3, a pair of side wall parts 28*a* and 28*b* provided on both sides of the base 27 in the left/right direction L3, and a cover frame 29 surrounding the base 27 and the respective side wall parts 28*a* and 28*b* from the front and the sides.

Figure 8:
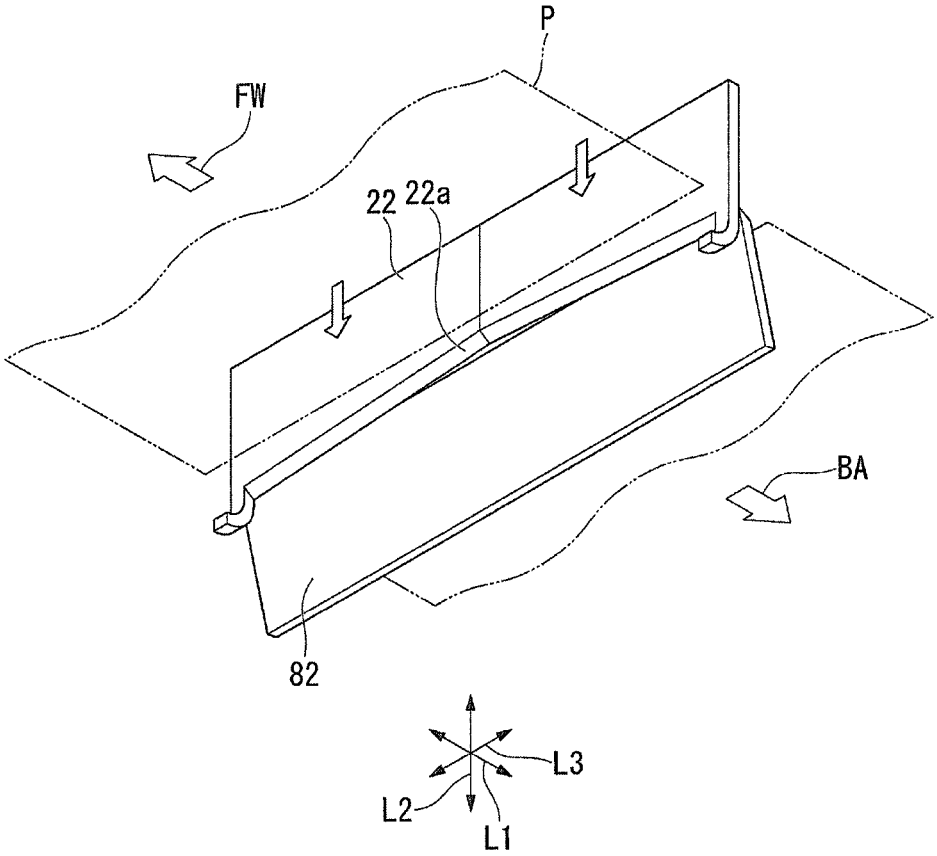
FIG. 8 is a view illustrating a state where recording paper is cut between a fixed blade and a movable blade by sliding the movable blade.

FIG. 8 is a view illustrating a state where the recording paper P is cut between a fixed blade 82 and the movable blade 22 by sliding the movable blade 22. As illustrated in FIG. 8, the movable blade 22 is provided to face the fixed blade 82 in the forward/backward direction L1 when the head unit 5 and the platen unit 4 are assembled with the printer cover 3 at the closed position. The movable blade 22 is a V-shaped and plate-shaped blade formed to have a length from the root to a blade tip 22*a* gradually shortened from both ends toward the center. As illustrated in FIG. 7, the movable blade 22 is fixed to a movable blade holder 31 on the root side. The movable blade holder 31 is shaped in a plate extending along the left/right direction L3, and structured slidably with respect to the head frame 23 in the vertical direction L2 by movement of the movable blade driving system 24.

Figure 9:
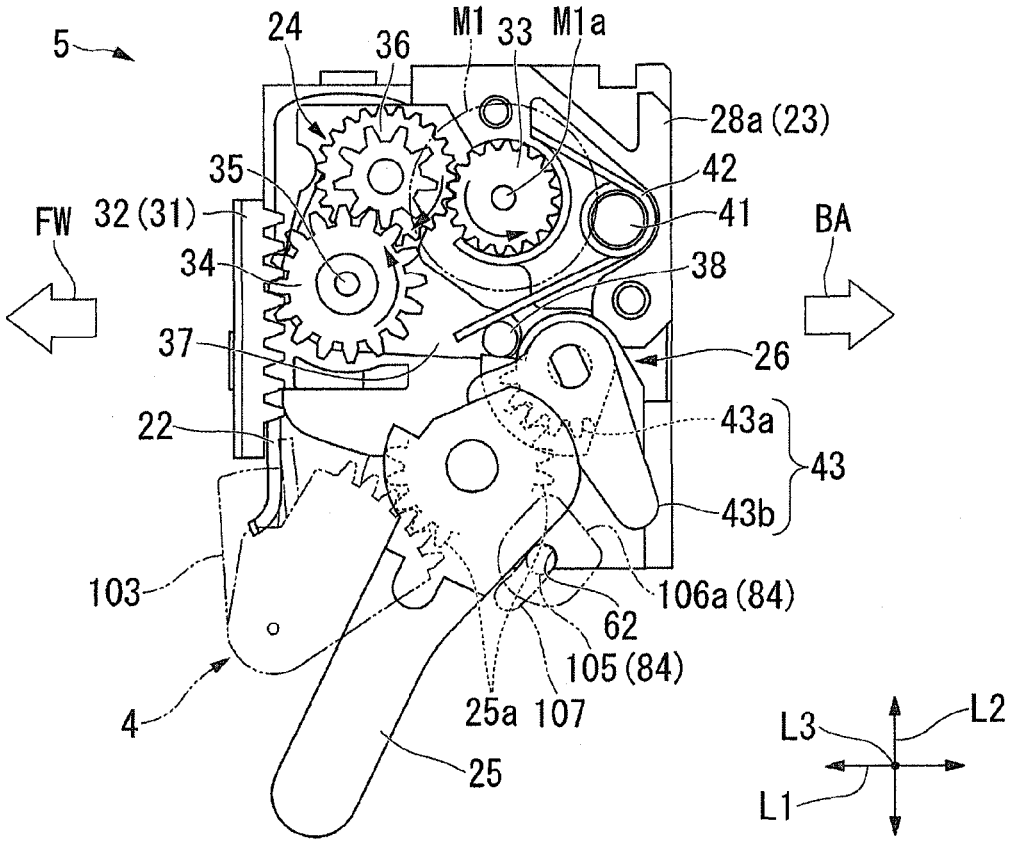
FIG. 9 is a view taken in the direction of an arrow D of FIG. 7.

FIG. 9 is a view taken in the direction of an arrow D of FIG. 7. As illustrated in FIGS. 7 and 9, the movable blade driving system 24 includes racks 32 mounted on the movable blade holder 31, a driving gear 33 that meshes with the racks 32 and is connected to a motor for cutter M1 turnable bidirectionally and to a driving shaft M1a of the motor for cutter M1, and pinions 34 that turn along with turn of the driving gear 33 and move the racks 32 linearly along the vertical direction L2.

The racks 32 are mounted as a pair on both end parts of the above-described movable blade holder 31 along the left/right direction L3 and extend along the vertical direction L2. The motor for cutter M1 is provided on the one side wall part 28*a* side between the respective side wall parts 28*a* and 28*b* of the head frame 23. The driving shaft M1a of the motor for cutter M1 penetrates through the one side wall part 28*a* and projects to the outside with respect to the one side wall part 28*a*. To the projection part, the driving gear 33 is connected. The pinions 34 are provided as a pair so as to mesh with the corresponding racks 32 respectively. The pinions 34 are connected to each other by a shaft 35 extending along the left/right direction L3. Between the driving gear 33 and one of the pinions 34 positioned on the one side wall part 28*a* side, an intermediate gear 36 meshing with both of them (the driving gear 33 and the pinion 34) is arranged. Thus, when driving of the motor for cutter M1 turns the driving gear 33, torque of the motor for cutter M1 is transmitted to the pinions 34 via the intermediate gear 36, moving the racks 32 linearly.

Figure 10:
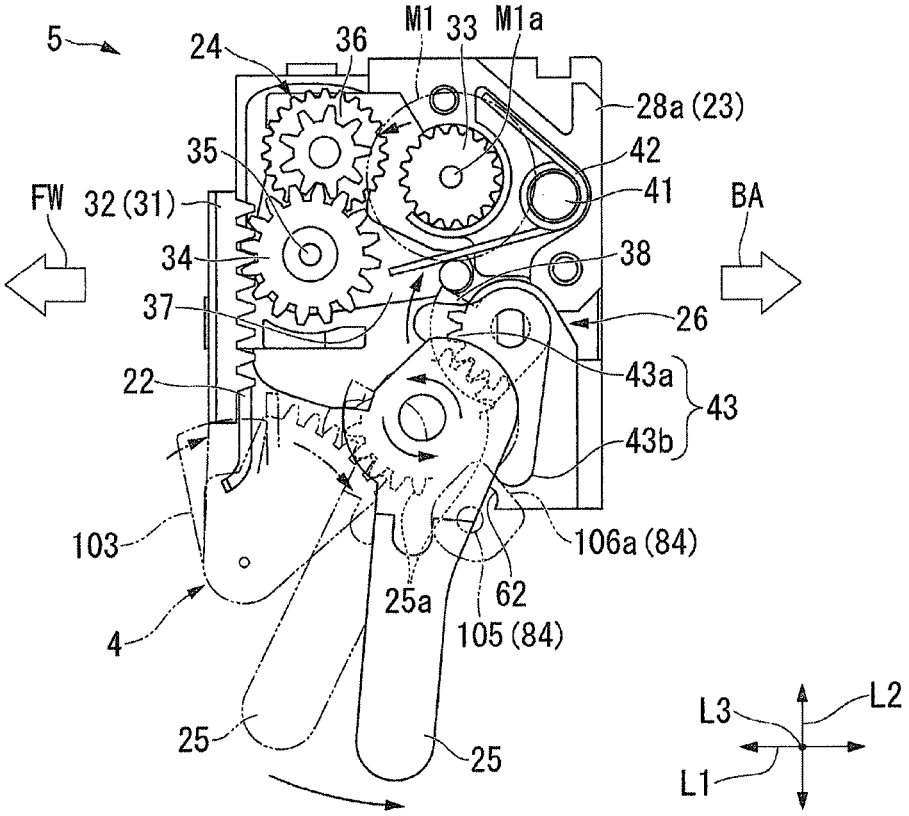
FIG. 10 is a side view of the head unit corresponding to FIG. 9 illustrating a mesh release state.

As illustrated in FIG. 9, by a part of the above-described shaft 35 positioned between the pinion 34 and the one side wall part 28*a*, an L-shaped swing plate 37 is supported swingably. The central part of the swing plate 37 is supported by the above-described shaft 35. Arms extend upward and backward BA respectively from the central part (in FIG. 9, only the arm extending backward is illustrated). The arm extending upward out of the arms supports the above-described intermediate gear 36 in a manner turnable. Therefore, when the swing plate 37 swings as illustrated in FIG. 10, the intermediate gear 36 swings forward around the shaft 35.

As illustrated in FIGS. 7 and 9, on the arm of the swing plate 37 extending backward out of the arms, a pin 38 projecting outward in the left/right direction L3 is provided. In addition, at a part of the one side wall part 28*a* of the head frame 23 positioned backward of the driving gear 33, a fixed pin 41 projecting outward in the left/right direction L3 is provided. To the fixed pin 41, a torsion spring 42 is fixed.

The torsion spring 42 interposes between the above-described pin 38 and the one side wall part 28*a* so as to bias the pin 38 in a direction away from the driving gear 33 (downward). Therefore, in normal state, the intermediate gear 36 and the driving gear 33 mesh with each other as described above (meshing state in FIG. 9). On the other hand, when the swing plate 37 swings in a direction against the biasing force of the torsion spring 42 (in the direction, the pin 38 moves toward the driving gear 33), the intermediate gear 36 moves away from the driving gear 33 and releases the meshing of the intermediate gear 36 and the driving gear 33, thereby releasing transmission of driving force to the movable blade 22 (mesh release state in FIG. 10). Note that, FIG. 10 is a side view of the head unit 5 corresponding to FIG. 9 illustrating mesh release state.

The above-described lever part 25 is supported in a manner turnable by a part of the one side wall part 28*a* positioned downward of the swing plate 37, allowing outward pressing operation. As illustrated in FIG. 5, the distal end part (lower end part) of the lever part 25 is fitted in the connection body 16 of the above-described release lever 13, whereby the lever part 25 is operated along with turn of the release lever 13. More specifically, as illustrated in FIG. 4, turning operation of the release lever 13 from the lock position P1 to the release position P2 turns the lever part 25. As illustrated in FIG. 9, at the proximal end of the lever part 25, an internal gear 25*a* is formed on the inner surface side in the left/right direction L3.

As illustrated in FIGS. 7 and 9, a fan-shaped release plate 43 is supported by the one side wall part 28*a* between the lever part 25 and the swing plate 37 on the one side wall part 28*a* side in a manner turnable. The release plate 43 includes a release gear 43*a* that meshes with a part of the internal gear 25*a* of the lever part 25, and a release cam 43*b* that releases the assembly between the head unit 5 and the platen unit 4. The release cam 43*b* projects downward from the turning center of the release plate 43. To the upper edge of the release plate 43, the pin 38 of the above-described swing plate 37 abuts. The pin 38 abuts on a side opposite to the torsion spring 42. Note that, the above-described swing plate 37, the torsion spring 42, and the release plate 43 function as the above-described release mechanism 26.

Figure 11:
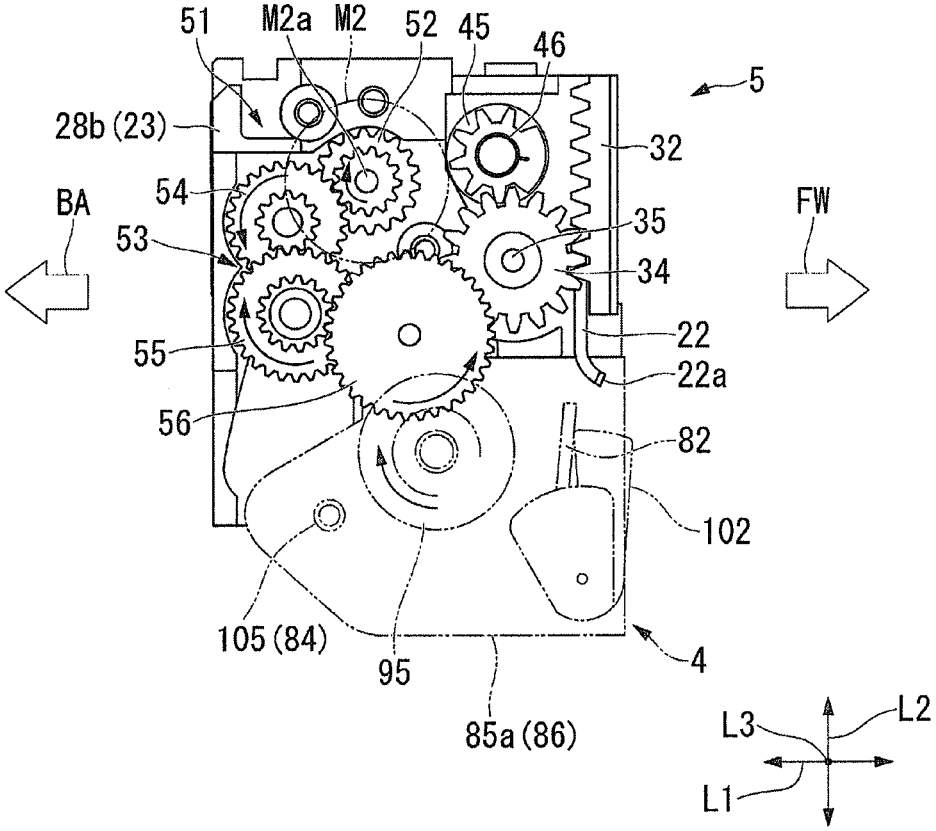
FIG. 11 is a view taken in the direction of an arrow E of FIG. 7.

FIG. 11 is a view taken in the direction of an arrow E of FIG. 7. As illustrated in FIG. 11, on the other side wall part 28*b* side of the head frame 23, a first gear 45 meshing with the other pinion 34 is supported by the other side wall part 28*b* in a manner turnable. In the first gear 45, a coil spring 46 is incorporated. The coil spring 46 is compressed and biases the first gear 45 in a direction reversing the pinion 34 when the pinion 34 turns and the movable blade 22 slides toward the fixed blade 82.

In the meshing state illustrated in FIG. 9, the pinion 34 on the other side wall part 28*b* side engages with the driving gear 33 via the shaft 35. Thus, the force of the coil spring 46 (refer to FIG. 10) does not reversely turn the pinion 34. On the other hand, in the mesh release state illustrated in FIG. 10, the engagement between the pinions 34 on the other side wall part 28*b* side with the driving gear 33 via the shaft 35 is released, whereby the force of the coil spring 46 reversely turns the pinion 34. As a result, the movable blade 22 can be automatically moved back to the original position.

As illustrated in FIG. 11, on the other side wall part 28*b* side, a platen driving mechanism 51 is provided behind the first gear 45. The platen driving mechanism 51 drives a platen roller 81 of the platen unit 4 when the head unit 5 and the platen unit 4 are assembled. The platen roller 81 will be described later. The platen driving mechanism 51 includes a motor for platen M2, a driving gear for platen 52 connected to a driving shaft M2a of the motor for platen M2, and a gear train for platen 53 meshing with the driving gear for platen 52. The gear train for platen 53 includes a second gear 54 meshing with the driving gear for platen 52, a third gear 55 meshing with the second gear 54, a fourth gear 56 meshing with the third gear 55 and meshing with a driven gear 95 of the platen roller 81. The driven gear 95 will be described later.

Figure 15:
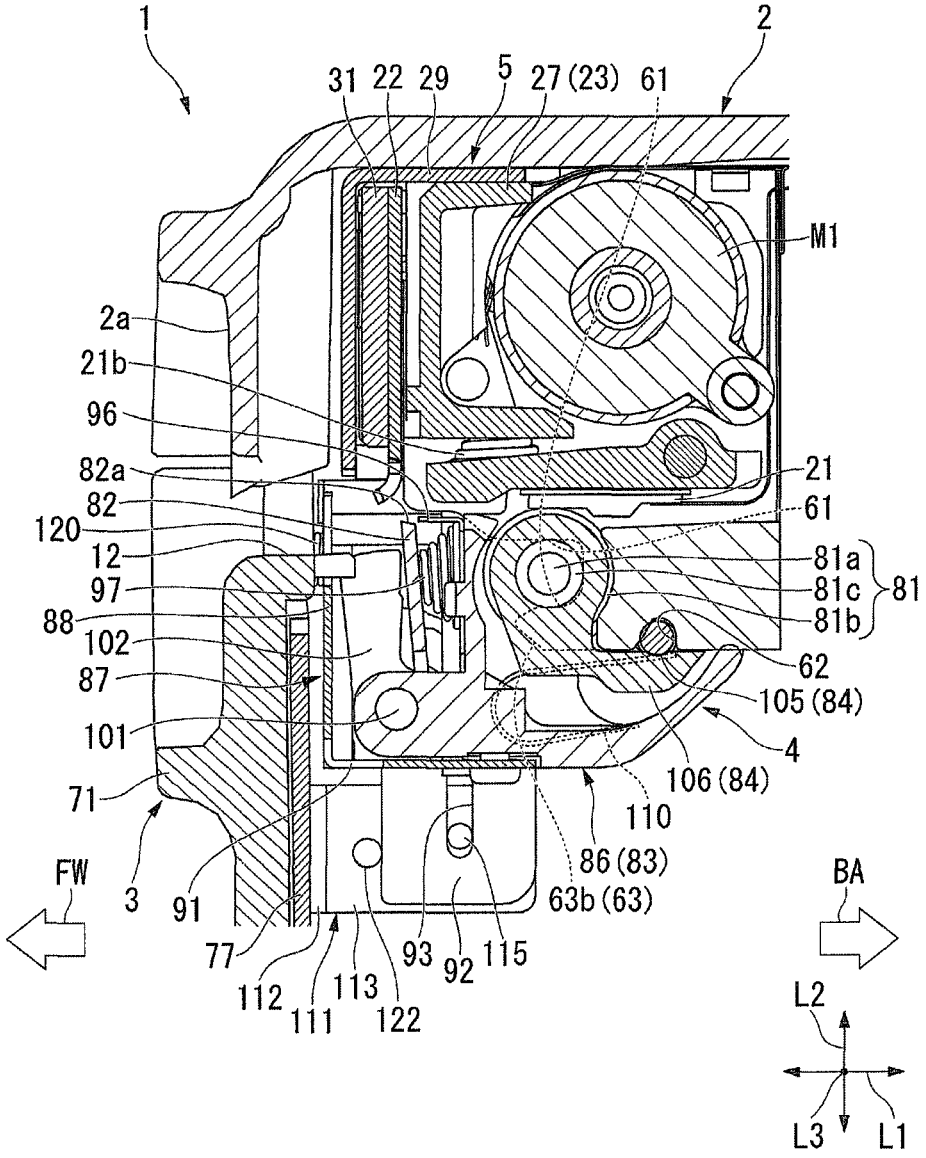
FIG. 15 is an enlarged sectional view of main parts in a sectional view taken along the line G-G of FIG. 3.

As illustrated in FIG. 7, the thermal head 21 is formed in a plate shape extending along the left/right direction L3 (the width direction of the recording paper P) forward of the base 27, and includes a plurality of heat generating elements 21*a* in a line along the left/right direction L3. The thermal head 21 faces the platen roller 81 when the printer cover 3 is at the closed position of as illustrated in FIG. 15. The recording paper P passes between the thermal head 21 and the platen roller 81. In addition, a coil spring 21*b* (refer to FIG. 15) interposes between the thermal head 21 and the base 27. The coil spring 21*b* biases the thermal head 21 downward (toward the platen roller 81). Thus, the thermal head 21 can be securely pressed to the recording paper P fed by the platen roller 81, enabling good printing.

As illustrated in FIGS. 6 and 7, at a part of the base 27 positioned backward BA of the thermal head 21, a guide support 57 that guides the recording paper P of the roll paper storage 10 to a position between the thermal head 21 and the platen roller 81 is provided.

In parts of the side wall parts 28*a* and 28*b* of the head frame 23 positioned downward of the thermal head 21 and frontward of the guide support 57, first recessed parts 61 and second recessed parts 62 are respectively formed.

Each first recessed part 61 is a rectangular recessed part opening forward FW, and houses a bearing member 81*c* of the platen roller 81 when the printer cover 3 is at the closed position. The bearing member 81*c* will be described later. At parts of the side wall parts 28*a* and 28*b* positioned downward of the first recessed parts 61, guide parts 63 are formed. The guide parts 63 are triangle in the side view. The width of the guide parts 63 in the vertical direction L2 gradually decreases toward the front (in forward direction FW). Each guide part 63 includes a platen guide 63*a* and a lock pin guide 63*b*. The platen guide 63*a* is an upper surface of the guide part 63 and the lock pin guide 63*b* is a lower surface of the guide part 63. The platen guide 63*a* guides the bearing member 81*c* of the platen roller 81 into the first recessed part 61, and the lock pin guide 63*b* guides a lock pin 105 to be described later into the second recessed part 62. The second recessed part 62 is a semicircular recessed part opening obliquely forward and downward, and receives the lock pin 105 of the platen unit 4 at the closed position of the printer cover 3. The lock pin 105 will be described later.

As illustrated in FIGS. 2 and 3, the printer cover 3 of the present embodiment includes an outer cover 71 exposed to the outside, and reinforcing members (a first reinforcing member 77 and a second reinforcing member 78) that are placed inside the outer cover 71 to reinforce the outer cover 71. The outer surface of the outer cover 71 forms appearance of the thermal printer 1 with the outer cover of the above-described casing 2. To the lower part of the outer cover 71, the above-described first turning shaft 11 is connected. At a part of the outer cover 71 positioned on one side (the side of the above-described release lever 13) along the left/right direction L3, an operation unit 73 that operates the thermal printer 1 is provided. Meanwhile, in a part of the outer cover 71 positioned upward of the operation unit 73, a recess 71*a* to avoid the release lever 13 provided on the casing 2 side is formed.

As illustrated in FIGS. 3 and 4, the operation unit 73 includes the operation buttons 74 and an operation board 75. The operation buttons 74 are, for example, a power button and a paper feed button, and arranged to expose to the outer surface of the outer cover 71 in a state where the buttons can be pressed. In the example of FIG. 3, the operation buttons 74 are arranged to align with the release lever 13 along the vertical direction L2.

On the operation board 75, a plurality of electronic components and switches (for example, membrane switches) that are turned ON when the operation buttons 74 are pressed are mounted although they are not illustrated. The operation board 75 is a board for controlling power ON/OFF operation and paper feed operation corresponding to pressing of the operation buttons 74. The operation board 75 is arranged on the inner surface side of the outer cover 71 at a position in back of the operation buttons 74. A board for comprehensively controlling operation of the thermal printer 1 is provided inside the casing 2 although it is not illustrated.

As illustrated in FIG. 3, the reinforcing members 77 and 78 include the first reinforcing member 77 provided at the upper part of the inner surface of the outer cover 71 and the second reinforcing member 78 provided lower than the first reinforcing member 77 (at a part lower than the above-described recess 71*a*).

Figure 12:
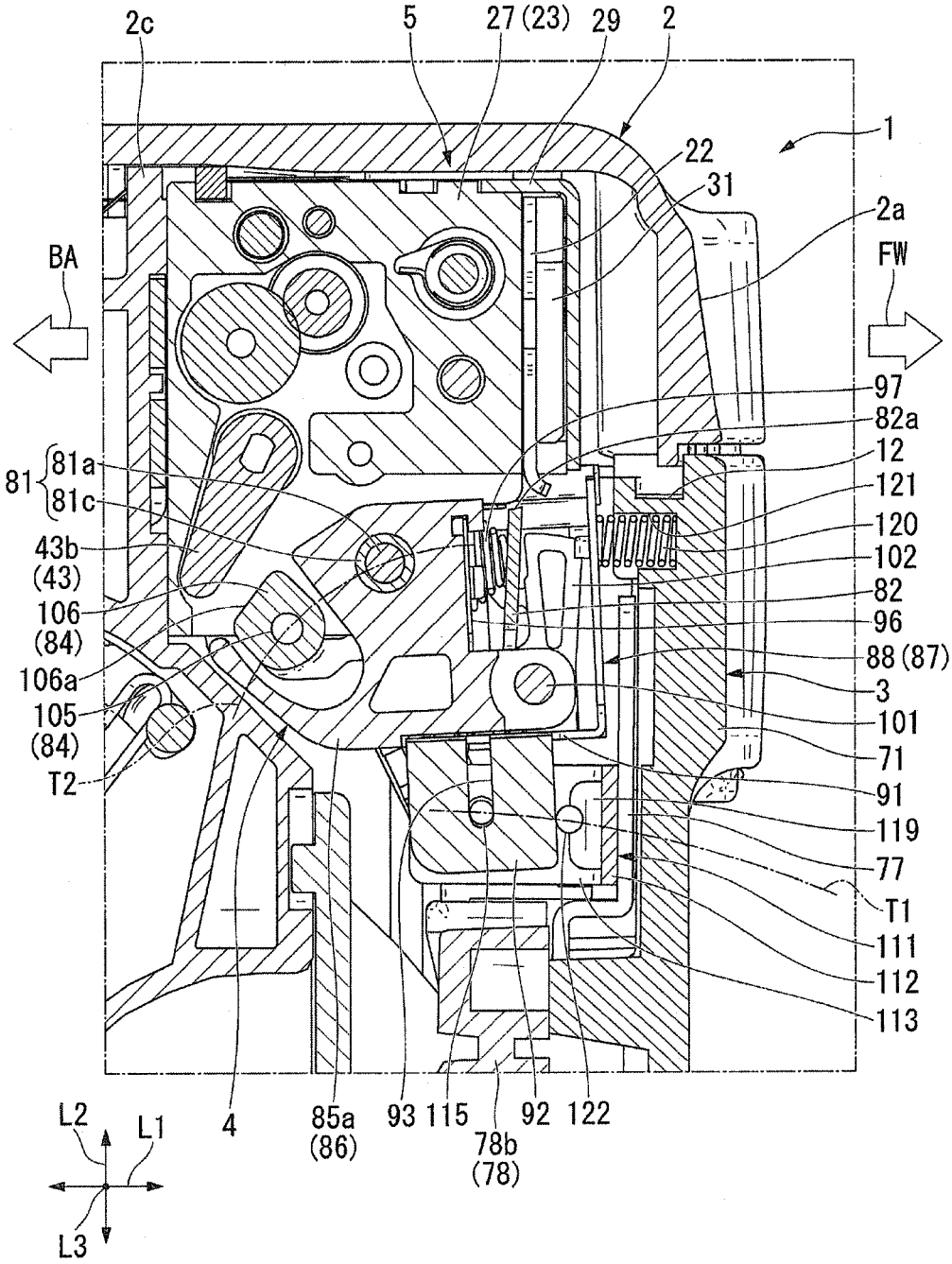
FIG. 12 is an enlarged sectional view of main parts in a sectional view taken along the line F-F in FIG. 3.

FIG. 12 is an enlarged sectional view of main parts in a sectional view taken along the line F-F in FIG. 3. As illustrated in FIG. 12, the first reinforcing member 77 is formed of a metal material or the like into a plate shape. The first reinforcing member 77 is provided along the left/right direction L3 at a part of the inner surface of the outer cover 71 positioned between the discharge port 12 and an upper part of the operation unit 73 along the vertical direction L2 (around a position for operating the printer cover 3). In this case, the first reinforcing member 77 is provided in an area of the platen unit 4 where the platen unit 4 overlaps at least a second turning shaft 115 (refer to FIG. 15) in the forward/backward direction L1.

As illustrated in FIGS. 3, 4 and 6, the second reinforcing member 78 is formed of a resin material or the like into a plate shape. The second reinforcing member 78 covers the whole inner surface of the outer cover 71 along the left/right direction L3. More specifically, the second reinforcing member 78 includes a protective cover 78*a* (refer to FIG. 4) covering the above-described operation board 75 from backward BA side and a roll paper guide part 78*b* covering the above-described roll paper storage 10 from forward FW side.

The roll paper guide part 78*b* is provided continuously from the protective cover 78*a* along the left/right direction L3. The inner surface side of the roll paper guide part 78*b* is formed into a curved surface depressed forward. The roll paper guide part 78*b* defines a roll paper housing space together with the above-described roll paper storage 10. On the outer surface side of the roll paper guide part 78*b*, mesh-like ribs 78*c* (refer to FIG. 6) extending along the vertical direction L2 and the left/right direction L3 are provided to stand forward FW. As illustrated in FIG. 12, the upper part of the second reinforcing member 78 is fixed to the outer cover 71 while overlapping the lower part of the first reinforcing member 77. The respective reinforcing members 77 and 78 are preferably formed of a hard material that is harder than a material constituting the above-described outer cover.

Figure 13:
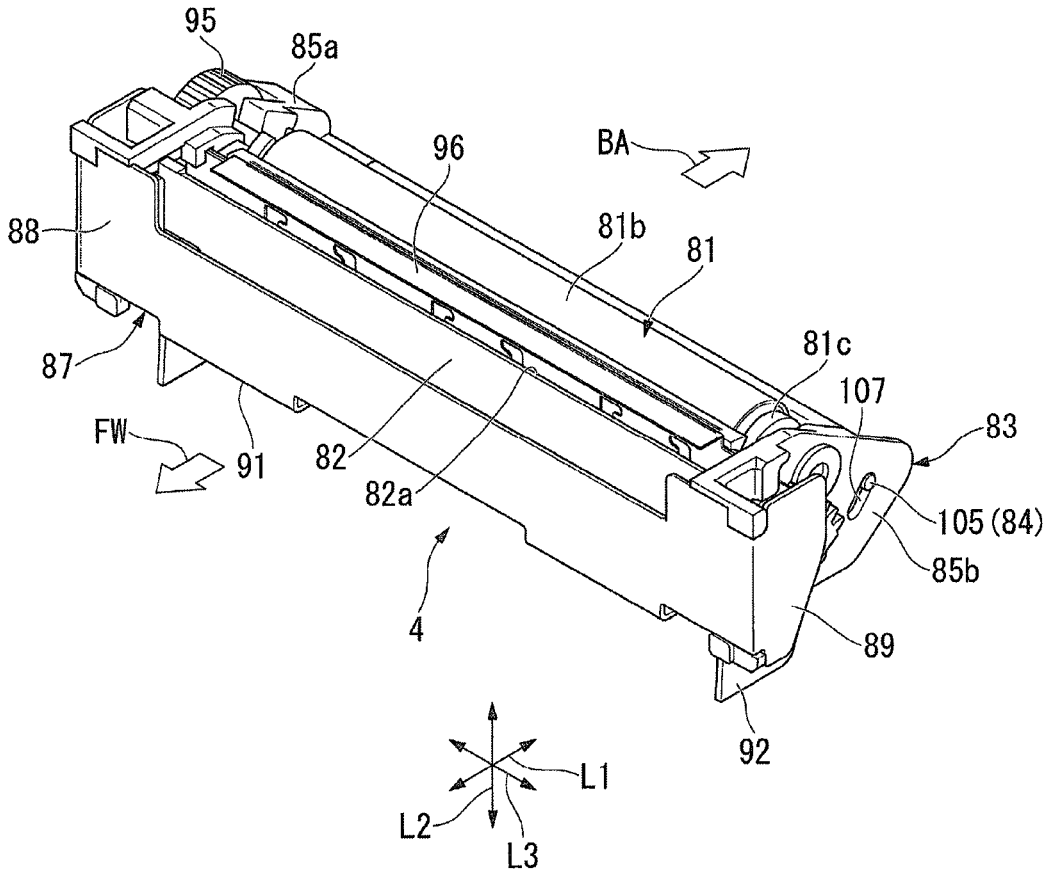
FIG. 13 is a perspective view of the platen unit.
Figure 14:
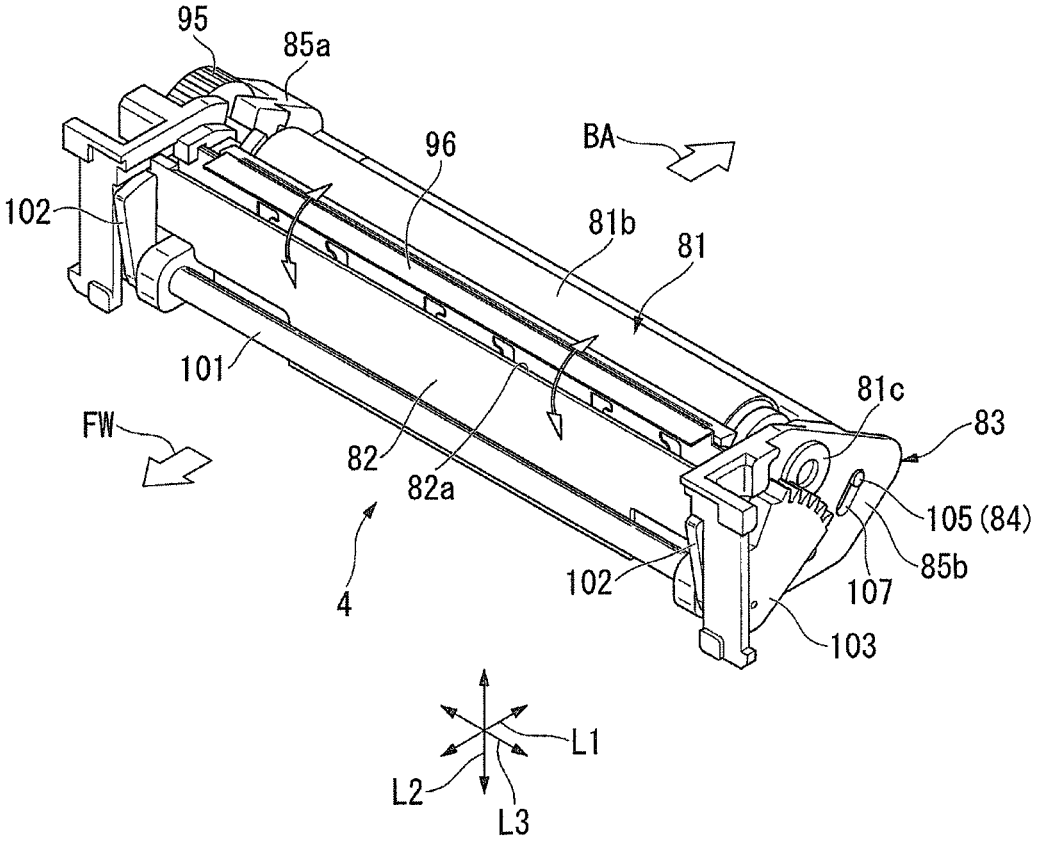
FIG. 14 is a perspective view of the platen unit illustrating a state where a cover frame is removed therefrom.

FIG. 13 is a perspective view of the platen unit 4, and FIG. 14 is a perspective view of the platen unit 4 illustrating a state where a cover frame 87 is removed therefrom. As illustrated in FIGS. 12 to 14, the platen unit 4 is mounted on the upper part of the inner surface of the printer cover 3 at a position where the printer cover 3 overlaps the above-described first reinforcing member 77 in the forward/backward direction L1. The platen unit 4 is assembled with the head unit 5 in a manner releasable along with open/close operation of the printer cover 3. More specifically, the platen unit 4 includes the platen roller 81 that feeds recording paper P, the fixed blade 82 provided forward FW of the platen roller 81, a platen frame 83 that supports the platen roller 81 and the fixed blade 82, and lock mechanisms 84 that assemble the platen unit 4 with the head unit 5.

The platen frame 83 includes a pair of side wall parts 85*a* and 85*b* facing each other in the left/right direction L3, a platen block 86 that supports the platen roller 81 in a manner turnable, and the cover frame 87 that covers the platen block 86 from forward side.

FIG. 15 is a sectional view taken along the line G-G in FIG. 3. As illustrated in FIGS. 13 and 15, the cover frame 87 is shaped in a plate extending along the left/right direction L3, and bent into L-shape in a sectional view to cover front side and bottom side of the platen block 86. More specifically, a front cover 88 of the cover frame 87 is positioned forward of the platen block 86, and provided to leave a gap from the platen block 86. On both ends of the front cover 88, a pair of side covers 89 (refer to FIG. 13) positioned on the outer side of the platen block 86 in the left/right direction L3 is formed. In addition, on an under cover 91 of the cover frame 87 positioned downward of the platen block 86, a pair of mounting pieces 92 connected to a base frame 111 to be described later is formed. The respective mounting pieces 92 project downward from both ends of the under cover 91 in the left/right direction L3. Each mounting piece 92 is formed with a mounting hole 93 (refer to FIG. 15) penetrating along the thickness direction thereof (the left/right direction L3). The each mounting hole 93 is a long hole extending along the vertical direction L2.

The platen roller 81 is arranged to have the outer surface being in contact with the above-described thermal head 21 on the head unit 5 side with recording paper P therebetween when the printer cover 3 is closed and the platen unit 4 is assembled with the head unit 5. More specifically, the platen roller 81 is formed by covering a platen shaft 81*a* extending along the left/right direction L3 with a roller body 81*b* formed of rubber or the like. The platen roller 81 is stored between the side wall parts 85*a* and 85*b* of the platen block 86, and is supported by the side wall parts 85*a* and 85*b* via the bearing members 81*c* provided on both ends of the platen shaft 81*a* in a manner turnable.

Parts of the bearing members 81*c* positioned inside the side wall parts 85*a* and 85*b* are fitted in the above-described first recessed parts 61 on the head unit 5 side when the platen unit 4 and the head unit 5 are assembled. On one end of the platen shaft 81*a* of the platen roller 81 along the left/right direction L3, the driven gear 95 is fixed to the outside of the side wall part 85*a*. As illustrated in FIG. 11, the driven gear 95 meshes with the above-described fourth gear 56 of the gear train for platen 53 on the head unit 5 side.

As illustrated in FIGS. 14 and 15, the fixed blade 82 is shaped in a plate extending along the left/right direction L3 in a part of the platen frame 83 between the platen block 86 and the cover frame 87. The fixed blade 82 is supported by a fixed blade holder 96 in such a manner that a blade tip 82*a* of the fixed blade 82 faces the fed recording paper P when the printer cover 3 is closed. At this time, the blade tip 82*a* side of the fixed blade 82 is supported swingably along the forward/backward direction L1 (direction perpendicular to the slide direction of the movable blade 22). Note that, a biasing member 97 (refer to FIG. 15) provided between the fixed blade holder 96 and the fixed blade 82 biases the fixed blade 82 so that the blade tip 82*a* side thereof moves away from the fixed blade holder 96.

Between the fixed blade 82 and the cover frame 87, a shaft 101 extending along the left/right direction L3 on the root side of the fixed blade 82 is supported by the side wall parts 85*a* and 85*b* of the platen block 86 in a manner turnable. To both ends of the shaft 101, a pair of depression parts 102 extending downward is connected. The depression parts 102 extend to a position where the distal end parts (upper end parts) face the blade tip 82*a* of the fixed blade 82 in the forward/backward direction L1. The depression parts 102 swing in the forward/backward direction L1 (direction closer to/away from the fixed blade 82) along with turning of the shaft 101. As illustrated in FIG. 14, on the other end side of the shaft 101, a sector gear 103 is connected to a part positioned outside the side wall part 85*b*. As illustrated in FIG. 9, the sector gear 103 meshes with the internal gear 25*a* of the above-described lever part 25 provided on the head unit 5 side when the printer cover 3 is closed.

As illustrated in FIGS. 14 and 15, each lock mechanism 84 includes the lock pin 105 extending in a direction parallel to the platen roller 81 in the lower part of the platen roller 81, and a lock pin support 106 that connects between the lock pin 105 and the platen roller 81. The lock pins 105 are fitted in the above-described second recessed parts 62, thus engaged therewith in a manner the lock pins can be disengaged therefrom. Both ends of the lock pins 105 are supported in long holes 107 (refer to FIG. 14) formed in the side wall parts 85*a* and 85*b*. Each long hole 107 has an elliptical shape tilting upward front to back toward the back and movably supports the lock pin 105.

As illustrated in FIGS. 12 and 15, each lock pin support 106 has a proximal end, to which the platen shaft 81*a* of the platen roller 81 is connected, and a distal end part, to which the lock pin 105 is connected. In a part of the distal end part of the lock pin support 106 at a position identical to the above-described release cam 43*b* in the left/right direction L3, a cam follower part 106*a* (refer to FIG. 12) projecting upward is formed. The cam follower part 106*a* is formed in such a manner that the cam follower part 106*a* can engage with the above-described release cam 43*b* when assembly between the platen unit 4 and the head unit 5 is released. Between the platen block 86 and the lock pins 105, biasing members 110 (refer to FIG. 15) that bias the lock pins 105 toward the upper end part side of the long holes 107 (upper end part side in FIG. 14) interpose.

Meanwhile, as illustrated in FIG. 12, the above-described platen unit 4 is fixed to the printer cover 3 via the base frame 111. The base frame 111 includes a fixed plate part 112 that is a plate material bent in a C shape in a top view and fixed to the printer cover 3, and a pair of mounting plate parts 113 provided at both ends of the fixed plate part 112 while standing backward. The fixed plate part 112 extends along the left/right direction L3 and is fixed to the inner surface of the printer cover 3 (the outer cover 71) together with the first reinforcing member 77 by a fastening member 119 such as a screw in a state where the fixed plate part 112 is superimposed with the above-described first reinforcing member 77 in the forward/backward direction L1.

Between the respective mounting plate parts 113, the second turning shaft 115 that bridges between the mounting plate parts 113 are provided. The second turning shaft 115 extends in a direction parallel to the above-described first turning shaft 11 along the left/right direction L3, and inserted through the respective mounting holes 93 of the above-described mounting pieces 92. Thus, the platen unit 4 is supported in a manner turnable around the second turning shaft 115 (dashed line T2 in FIG. 12), and movable along an extending direction of the mounting holes 93 with respect to the second turning shaft 115 (the base frame 111).

More specifically, the platen unit 4 is formed in a manner turnable in the open/close directions of the printer cover 3 around the turning center (the second turning shaft 115) that is parallel to the turning center (the first turning shaft 11) of the printer cover 3. In addition, the platen unit 4 is formed slidably in the vertical direction L2 (direction closer to/away from the head unit 5 in a state where the platen unit 4 is assembled with the head unit 5) out of in-plane directions (L2 and L3) of the printer cover 3. The vertical direction L2 is perpendicular to the second turning shaft 115. Meanwhile, at a part of the base frame 111 positioned forward of the above-described mounting pieces 92, stopper pins 122 that can abut the mounting pieces 92 from the forward side are provided.

Between the platen unit 4 and the printer cover 3, there are provided coil springs (biasing member) 120 that bias the platen unit 4 toward the close direction of the printer cover 3 out of turn directions (the open/close directions of the printer cover 3) around the second turning shaft 115. More specifically, in a part of the outer cover 71 that is upward of the base frame 111 and faces the front cover 88 in the forward/backward direction L1, hollow parts 121 opening backward are formed and house the coil springs 120. Each coil spring 120 interposes between the bottom of each hollow part 121 and the front cover 88, and biases the platen unit 4 in the close direction of the printer cover 3 (direction away from the printer cover 3). Note that, the hollow parts 121 are formed in a plurality (for example, two) at an interval along the left/right direction L3, and each of the hollow parts 121 houses each of the coil springs 120.

Next, operation of the above-described thermal printer 1 will be described. First, as illustrated in FIGS. 1 and 2, the roll paper R is put into the roll paper storage 10 of the casing 2. The printer cover 3 is then closed. At this time, certain length of paper is previously drawn from the recording paper P out of the casing 2. The printer cover 3 is then closed with the drawn recording paper P drawn out of the casing 2. The platen unit 4 and the head unit 5 are thus assembled, locking the printer cover 3 to the casing 2. Thus, the recording paper P is sandwiched between the platen roller 81 and the thermal head 21 while being drawn out of the casing 2 through the discharge port 12.

Next, various types of information are printed on the recording paper P. As illustrated in FIG. 11, the motor for platen M2 is driven first to rotate the driving gear for platen 52. The torque of the driving gear for platen 52 is then transmitted to the driven gear 95 via the gear train for platen 53, thereby rotating the platen roller 81. Thus, the recording paper P sandwiched between the platen roller 81 and the thermal head 21 can be fed. At the same time, a control signal corresponding to print data is output to the thermal head 21, appropriately causing the heat generating elements 21*a* to generate heat. Thus, various characters, figures, and the like can be clearly printed on the recording paper P being fed. Thereafter, the recording paper P after printing passes between the fixed blade 82 and the movable blade 22.

Next, when the recording paper P is cut as illustrated in FIG. 10, the motor for cutter M1 is driven to rotate the driving gear 33. The torque of the driving gear 33 is then transmitted to the racks 32 via the intermediate gear 36 and the pinions 34, thereby sliding the movable blade 22 toward the fixed blade 82 side together with the movable blade holder 31. Thus, as illustrated in FIG. 8, the movable blade 22 rides on the front surface of the fixed blade 82, whereby the recording paper P can be cut between the movable blade 22 and the fixed blade 82. Then, the cut off recording paper P can be used as a receipt, a ticket, or the like. Since the fixed blade 82 swings in the forward/backward direction L1 perpendicular to the slide direction of the movable blade 22, and is biased forward by the biasing member 97, the fixed blade 82 is in contact with the movable blade 22 with an appropriate contact pressure. Therefore, a gap is not made between the blade tip 82*a* of the fixed blade 82 and the blade tip 22*a* of the movable blade 22, enabling to cut off the recording paper P with excellent sharpness.

Next, operation of the printer cover 3 during opening operation of the printer cover 3 will be described. First, as illustrated in FIG. 4, the release lever 13 is turned from the lock position P1 to the release position P2 while a finger put on the operation projecting piece 15*a* of the release lever 13. The lever part 25 of the head unit 5 then turns backward interlocked with the release lever 13. Thus, as illustrated in FIG. 10, the sector gear 103 meshing with the internal gear 25*a* of the lever part 25 turns, whereby the fixed blade 82 swings in a direction away from the movable blade 22 (backward) via the depression parts 102. In addition, the release plate 43 meshing with the internal gear 25*a* of the lever part 25 turns, pressing the pin 38 in a direction against the bias force of the torsion spring 42 via the release plate 43. Thus, the swing plate 37 swings, making the above-described mesh release state. In the mesh release state, meshing between the intermediate gear 36 and the driving gear 33 is released, and transmission of torque from the motor for cutter M1 to the movable blade 22 is cut off.

Furthermore, when the release plate 43 turns, the release cam 43*b* of the release plate 43 engages with the cam follower part 106*a* on the platen unit 4 side, pushing out the cam follower part 106*a* in a direction for disengaging the lock pin 105 from the second recessed part 62. Disengagement of the lock pins 105 from the second recessed parts 62 releases assembly between the platen unit 4 and the head unit 5. In other words, the release plate 43 of the present embodiment has a function of cutting off transmission of the torque of the motor for cutter M1 as well as a function of disengaging the lock pins 105. The release plate 43 then turns the printer cover 3 in the open direction in a state where the lock pins 105 are disengaged from the second recessed parts 62, whereby the bearing members 81*c* of the platen roller 81 are disengaged from the first recessed parts 61, and the roll paper storage 10 is made open. Since the printer cover 3 then comes at the open position, the roll paper R can be taken out from the inside of the roll paper storage 10 or can be replaced.

Figure 16:
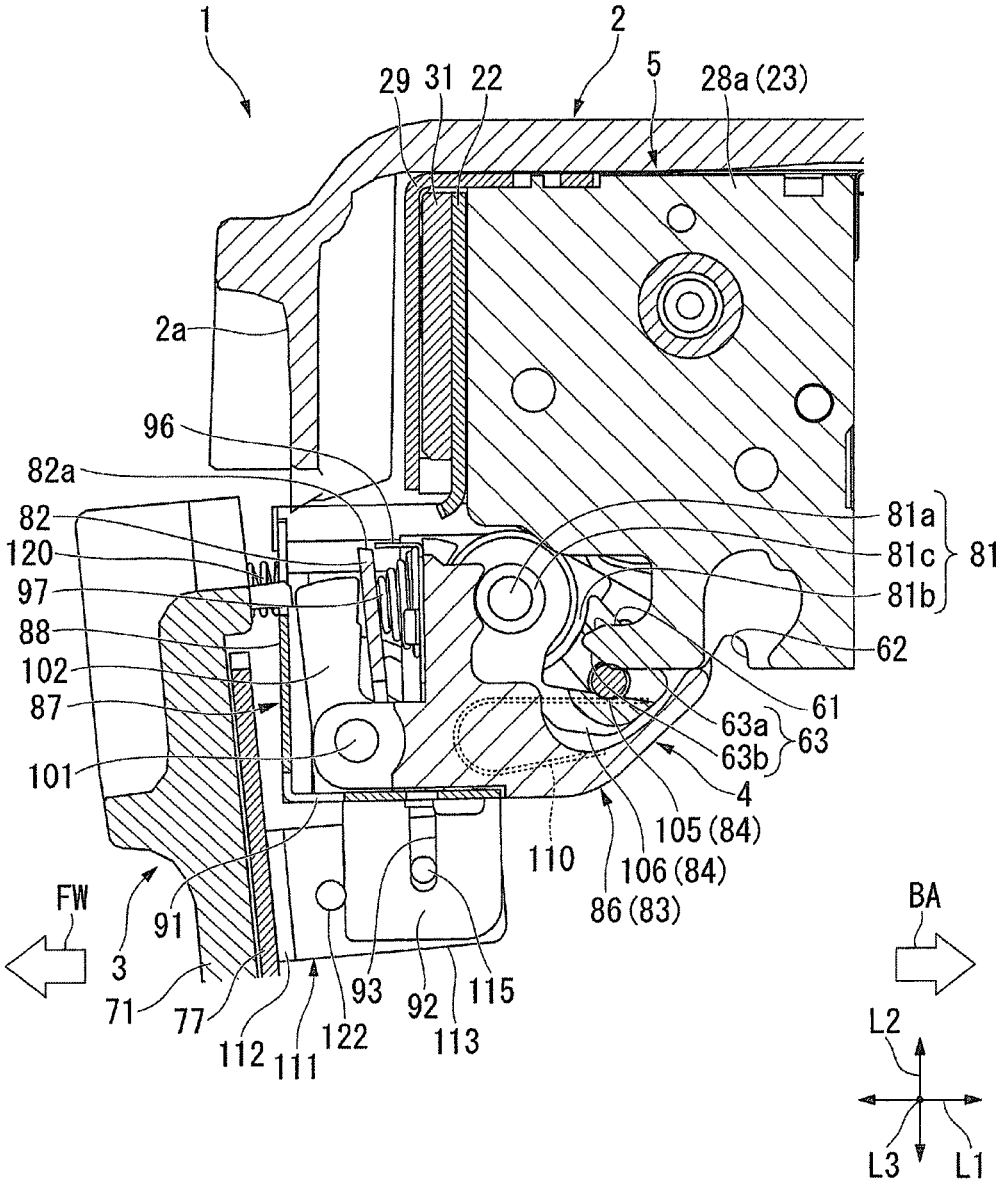
FIG. 16 is an enlarged sectional view of main parts in a sectional view taken along the line H-H of FIG. 3 and is an explanatory drawing for describing operation during open/close operation of the printer cover.
Figure 17:
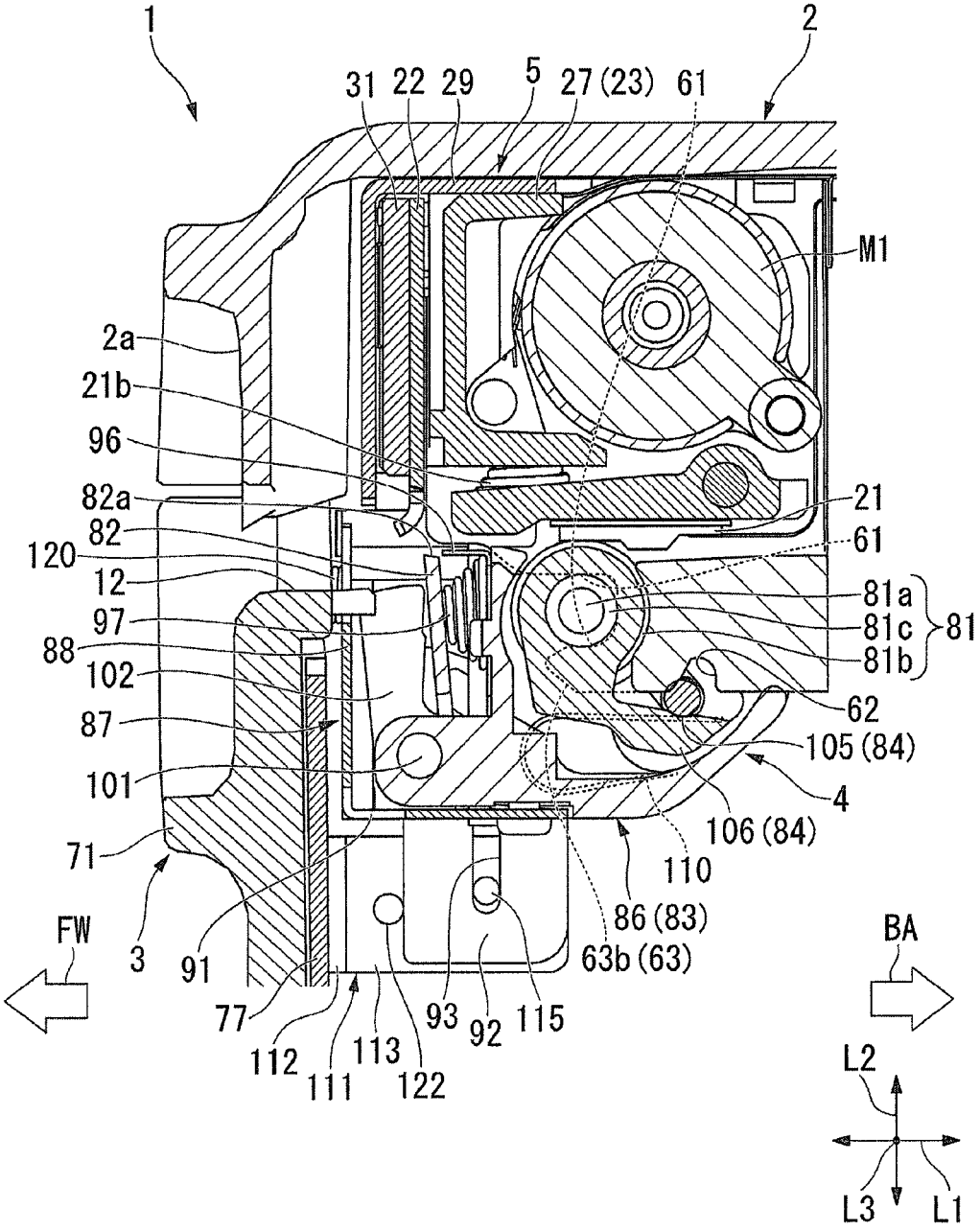
FIG. 17 is an enlarged sectional view of main parts corresponding FIG. 15 and is an explanatory drawing for describing operation during open/close operation of the printer cover.

Here, operation of the above-described printer cover 3 during close operation will be described in detail. FIGS. 16 and 17 are explanatory drawings for describing operation during open/close operation of the printer cover 3. FIG. 16 is an enlarged sectional view of main parts in a sectional view taken along the line H-H in FIG. 3, and FIG. 17 is an enlarged sectional view of main parts corresponding to FIG. 15. Note that, in an initial state (open position), the coil springs 120 bias the platen unit 4 in the close direction of the printer cover 3 around the second turning shaft 115, maintaining the platen unit 4 in a state where the front cover 88 tilts with respect to the inner surface of the outer cover 71. First, as illustrated in FIG. 16, the printer cover 3 is turned in the close direction around the first turning shaft 11 (refer to FIG. 6). When the platen unit 4 and the head unit 5 come close to each other, the lock pin 105 on the platen unit 4 side comes into contact with the lock pin guide 63*b* on the head unit 5 side. In this state, the printer cover 3 is further pressed in the close direction, whereby the lock pin guides 63*b* pushes the lock pins 105 away downward (in a direction against the bias force of the biasing member 110), moving the lock pin guides 63*d* toward the lower end part side in the long holes 107 (refer to FIG. 14).

Thereafter, the lock pins 105 are in sliding contact with the lower edges of the lock pin guides 63*b* and the side wall parts 28*a* and 28*b* of the head frame 23. In addition, the platen roller 81 enters into the first recessed parts 61 of the head unit 5 while the bearing members 81*c* are guided by the platen guides 63*a*. The platen unit 4 turns around the second turning shaft 115 in a direction closer to the printer cover 3 (direction against the bias force of the coil springs 120). Thus, the printer cover 3 moves in the close direction.

Next, as illustrated in FIG. 17, the lock pins 105 reach the second recessed parts 62 at timing when the bearing members 81*c* of the platen roller 81 are fitted in the first recessed parts 61 of the head unit 5. At this time, the lock pins 105 move toward the upper end part side in the long holes 107 (refer to FIG. 14) by the bias force of the biasing members 110. Thus, the lock pins 105 are fitted in the second recessed parts 62. As a result, as illustrated in FIG. 15, the platen unit 4 and the head unit 5 are assembled and the printer cover 3 comes at the closed position. When the printer cover 3 is at the closed position, the front cover 88 of the platen unit 4 and the outer cover 71 are kept in parallel to each other.

Here, opening directions of the first recessed parts 61 and the second recessed parts 62 are different. Thus, when the bearing members 81*c* of the platen roller 81 are fitted in the first recessed parts 61 and the lock pins 105 are fitted in the second recessed parts 62, the lock pins 105 prevent the bearing members 81*c* from moving along the opening direction of the first recessed parts 61. As described above, the design is made not to allow the bearing members 81*c* to be disengaged from the inside of the first recessed parts 61 unless the lock pins 105 are disengaged from the inside of the second recessed parts 62. Therefore, the platen unit 4 and the head unit 5 can be securely locked.

Note that, in a state where the platen unit 4 and the head unit 5 are assembled, the driven gear 95 on the platen unit 4 side meshes with the fourth gear 56 on the head unit 5 side, and the sector gear 103 on the platen unit 4 side meshes with the internal gear 25*a* on the head unit 5 side.

Meanwhile, according to the thermal printer 1 of the present embodiment, the platen unit 4 is not fixed integrally to the printer cover 3, but is mounted on the printer cover 3 slidably in the vertical direction L2 along the printer cover 3 and swingably around the second turning shaft 115 that is parallel to the first turning shaft 11. Therefore, the whole platen unit 4 appropriately slides and swings with respect to the printer cover 3 during close operation of the printer cover 3, whereby component precision error, assembly error, or the like of the respective components can be canceled, if any. Thus, the bearing members 81*c* of the platen roller 81 can be securely fitted in the first recessed parts 61.

In particular, in the present embodiment, the coil springs 120 bias the platen unit 4 in the close direction of the printer cover 3, suppressing looseness of the platen roller 81 (the platen unit 4) with respect to the printer cover 3. Thus, during close operation of the printer cover 3, variation of relative positions of the platen unit 4 on the printer cover 3 side with respect to the head unit 5 on the casing 2 side can be suppressed, and variation of pressing force on the printer cover 3 due to influence of operation positions of the printer cover 3 can be suppressed. As a result, the bearing members 81*c* on both ends can be securely locked to the head unit 5 even by pressing one side of the printer cover 3. As a result, conventionally caused one-side lock is not caused and secure assembly between the thermal head 21 and the platen roller 81 in an appropriate setting state is possible. Therefore, occurrence of paper jam and the like can be suppressed as well as high quality printing is possible.

In addition, the printer cover 3 of the present embodiment is structured with two components including the outer cover 71 and the reinforcing members 77 and 78 reinforcing the outer cover 71, enabling weight reduction and material cost reduction while securing rigidity of the whole printer cover 3 comparing to a printer cover 3 structured with one component. In addition, since rigidity of the printer cover 3 is secured, deformation such as deflection and twisting of the outer cover 71 during close operation of the printer cover 3 can be suppressed. Thus, the whole platen shaft 81*a* can be uniformly pressed regardless of an operation position of the printer cover 3, securely suppressing the above-described one-side lock.

Furthermore, in the present embodiment, the first reinforcing member 77 is arranged at a position of the printer cover 3 where the printer cover 3 overlaps the second turning shaft 115, the position being closer to the operation position of the printer cover 3 rather than the first turning shaft 11 side, thereby securing rigidity around the operation position of the printer cover 3. Therefore, the above-described one-side lock can be securely suppressed. In addition, in the present embodiment, the coil springs 120 bias the platen unit 4 as described above. Thus, even when the first reinforcing member 77 is made of a metal material having high rigidity, variation of contact resistance value between metal parts of the platen unit 4 (for example, the cover frame 87) and the first reinforcing member 77 can be reduced, improving electrostatic noise resistance.

Furthermore, since the second reinforcing member 78 is arranged at a part of the outer cover 71 between the first turning shaft 11 and the second turning shaft 115, rigidity against moment around the first turning shaft 11 can be secured during close operation of the printer cover 3, whereby the above-described one-side lock can be securely suppressed. In addition, since in the present embodiment, the second reinforcing member 78 is formed of a resin material as described above, frictional resistance between the roll paper R and the roll paper guide part 78*b* of the second reinforcing member 78 can be reduced and the roll paper R can be rotated smoothly.

Note that, the technical scope of the present invention is not limited to the above-described embodiment and various changes are possible without departing from the spirit of the present invention. For example, in the above-described embodiment, an example where the recording paper P is discharged forward has been described, but installation posture of the printer can be arbitrarily changed. For example, the printer may be used in such a manner that the recording paper P is discharged upward by setting the casing 2 vertically.

In addition, appropriate design changes of various mechanisms such as the mechanism of assembling the platen unit 4 and the head unit 5, and the mechanism of moving the movable blade 22 as described in the embodiment is possible. Furthermore, in the above-described embodiment, the printer cover 3 constituted of the outer cover 71 and the reinforcing members 77 and 78 has been described, but the printer cover 3 may be constituted of more components or may be composed of one component. In the above-described embodiment, the base frame 111 and the first reinforcing member 77 are formed separately, but the base frame 111 and the first reinforcing member 77 may be integrally formed, for example.

In the above-described embodiment, the head unit 5 includes the movable blade 22, and the platen unit 4 includes the fixed blade 82, but any other structure is possible. For example, the head unit 5 may include the fixed blade 82 and the platen unit 4 may include the movable blade 22. Alternatively, neither the fixed blade 82 nor the movable blade 22 may be provided. Furthermore, in the above-described embodiment, the coil spring 120 is employed as a biasing member of the present invention, but a flat spring or the like may be employed.

In addition, in the above-described embodiment, the release lever 13 is turned between the lock position P1 and the release position P2, but other than the turning operation may be utilized. For example, push down operation or sliding operation may be utilized to operate the release lever 13. The operation utilized here is required at least to enable releasing of lock of the printer cover 3 by reciprocating the printer cover 3 between the lock position P1 and the release position P2.

Furthermore, for example, any of the following mechanisms may be added to the thermal printer 1 of above-described embodiment:

(1) a mechanism for detecting remaining amount of the roll paper R and confirm the detected remaining amount;

(2) a mechanism for detecting identification such as a mark provided clearly on the recording paper P by printing or the like;

(3) a mechanism for reducing conveying load of the recording paper P;

(4) a mechanism for removing slack of the recording paper P such as a tension roller;

(5) a damper mechanism with respect to momentary tension of the recording paper P;

(6) a mechanism for decurling the recording paper P; and (7) a damper mechanism for regulating sudden open/close operation of the printer cover 3.

What is claimed is:

1. A thermal printer comprising:

a casing that houses recording paper;

a printer cover connected to the casing in a manner turnable with respect to the casing around a first turning shaft for opening/closing the casing;

a head unit provided on the casing and including a thermal head; and a platen unit provided on the printer cover and connected to the head unit in a manner releasable along with an opening/closing operation of the printer cover, the platen unit including a platen roller for feeding the recording paper, wherein the platen unit is mounted on the printer cover in a manner turnable around a second turning shaft that is parallel to the first turning shaft and slidable along a direction perpendicular to the second turning shaft, wherein the thermal printer further includes a biasing member provided between the printer cover and the platen unit for biasing the platen unit toward a closing direction of the printer cover around the second turning shaft; and wherein the platen unit includes a platen block supporting the platen roller, a cover frame covering the platen block, and a pair of mounting pieces extending from the cover frame, each of the pair of mounting pieces having a mounting hole through which the second turning shaft extends and along which the platen unit is slidable in the direction perpendicular to the second turning shaft.

2. A thermal printer according to claim 1, wherein the printer cover comprises:

an outer cover exposed to the outside; and a reinforcing member that reinforces the outer cover from an inner surface side thereof.

3. A thermal printer according to claim 2, wherein the reinforcing member is provided in an area of the outer cover positioned between the first turning shaft and the second turning shaft.

4. A thermal printer according to claim 1, wherein the printer cover comprises an outer cover, a first reinforcing member provided in an upper part of the inner surface of the outer cover, and a second reinforcing member provided in a lower part of the inner surface of the outer cover.

5. A thermal printer comprising:

a casing having a storage section for storing recording paper;

a printer cover mounted to the casing for undergoing rotational movement around a first rotational shaft in an opening direction to open the storage section of the casing and in a closing direction to close the storage section of the casing;

a head unit mounted on the casing and having a thermal head for printing on the recording paper;

a platen unit having a platen roller for feeding the recording paper, the platen unit being mounted to the printer cover for undergoing rotational movement around a second rotational shaft and sliding movement along a direction perpendicular to the second rotational shaft so as to connect the platen unit with the head unit when the printer cover undergoes rotational movement about the first rotational shaft in the closing direction and so as to disconnect the platen unit from the head unit when the printer cover undergoes rotational movement about the first rotational shaft in the opening direction; and a biasing member provided between the printer cover and the platen unit for biasing the platen unit around the second rotational shaft toward a closing direction of the printer cover;

wherein the platen unit includes a platen block supporting the platen roller, a cover frame covering the platen block, and a pair of mounting pieces extending from the cover frame, each of the pair of mounting pieces having a mounting hole through which the second rotational shaft extends and along which the platen unit is slidable in the direction perpendicular to the second rotational shaft.

6. A thermal printer according to claim 5, wherein the printer cover comprises an outer cover and a reinforcing member for reinforcing the outer cover.

7. A thermal printer according to claim 6, wherein the reinforcing member is provided in an area of the outer cover positioned between the first rotational shaft and the second rotational shaft.

8. A thermal printer according to claim 5, wherein the printer cover comprises an outer cover, a first reinforcing member provided in an upper part of the inner surface of the outer cover, and a second reinforcing member provided in a lower part of the inner surface of the outer cover.

9. A thermal printer according to claim 5, wherein the second rotational shaft is parallel to the first rotational shaft.

10. A thermal printer according to claim 5, wherein the second rotational shaft is parallel to the first rotational shaft.

* * * * *